US008678553B2

(12) United States Patent
Takata et al.

(10) Patent No.: US 8,678,553 B2
(45) Date of Patent: Mar. 25, 2014

(54) RECORDING APPARATUS AND PRINTING FLUID CARTRIDGE SET

(75) Inventors: Masayuki Takata, Nagoya (JP); Hisaki Sakurai, Aichi-ken (JP); Jiro Yamamoto, Nagoya (JP); Yasunari Yoshida, Aichi-ken (JP); Yuji Koga, Nagoya (JP); Katsuro Miura, Toyota (JP); Isao Kubo, Tokoname (JP); Motohito Muraki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/606,372

(22) Filed: Sep. 7, 2012

(65) Prior Publication Data

US 2013/0063532 A1 Mar. 14, 2013

(30) Foreign Application Priority Data

Sep. 9, 2011 (JP) ..... 2011-197184
Sep. 9, 2011 (JP) ..... 2011-197189

(51) Int. Cl.
*B41J 2/14* (2006.01)
*B41J 2/175* (2006.01)

(52) U.S. Cl.
USPC ..... 347/49; 347/86

(58) Field of Classification Search
USPC ..... 347/49, 85, 86
See application file for complete search history.

(56) References Cited

U.S. PATENT DOCUMENTS

| | | | | |
|---|---|---|---|---|
| 6,142,602 | A * | 11/2000 | Tanaka | 347/29 |
| 6,203,146 | B1 * | 3/2001 | Pawlowksi et al. | 347/85 |
| 6,779,880 | B1 * | 8/2004 | Kulpa et al. | 347/86 |
| 7,222,951 | B2 | 5/2007 | Hattori et al. | |
| 7,264,331 | B2 * | 9/2007 | Tanno | 347/32 |
| 7,562,958 | B2 * | 7/2009 | Asauchi | 347/19 |
| 7,562,972 | B2 * | 7/2009 | Hattori et al. | 347/86 |
| 2007/0070156 | A1 | 3/2007 | Steinmetz et al. | |

FOREIGN PATENT DOCUMENTS

| | | |
|---|---|---|
| JP | 2002-166573 | 6/2002 |
| JP | 2007/196651 | 8/2003 |
| JP | 2003-266732 | 9/2003 |
| JP | 2007/500617 | 1/2007 |

* cited by examiner

*Primary Examiner* — Anh T. N. Vo
(74) *Attorney, Agent, or Firm* — Frommer Lawrence & Haug LLP

(57) ABSTRACT

A recording apparatus has a cartridge installing section including a case which is formed with an opening and which is configured to receive printing fluid cartridges respectively via the opening; a flat plate-shaped lid which has a rotational shaft and which undergoes posture change to a closed posture and an open posture by being rotated around the rotational shaft. The lid has a curved section which is disposed on a side of one end in a widthwise direction along the rotational shaft and which is curved so that the one end is directed to a side of the ending surface of the case in a state in which the lid is in the closed posture; and the curved section is upstanding upwardly from a side of a bottom surface of the case in a state in which the lid is in the open posture.

12 Claims, 13 Drawing Sheets

RECORDING APPARATUS AND PRINTING FLUID CARTRIDGE SET

CROSS REFERENCE TO RELATED APPLICATION

The present application claims priorities from Japanese Patent Application Nos. 2011-197184 and 2011-197189 both filed on Sep. 9, 2011, the disclosures of which are incorporated herein by reference in their entirety.

BACKGROUND OF THE INVENTION

1. Field of the Invention

The present teaching relates to a recording apparatus which has a cartridge installing section in which a plurality of printing fluid cartridges are installed, and a printing fluid cartridge set which is to be installed to the cartridge installing section.

2. Description of the Related Art

Conventionally, an image recording apparatus based on the ink-jet system is known. In the image recording apparatus, ink droplets are jetted from nozzles of a recording head toward the recording paper. The ink droplets are landed on the recording paper, and thus a desired image is recorded. An ink cartridge is provided for the image recording apparatus installably/removably in order to store an ink to be supplied to the recording head.

Ink cartridges of a plurality of colors are installed to an image recording apparatus capable of performing the color recording. Each of the ink cartridges stores an ink of one color. Therefore, the plurality of ink cartridges are installed to the image recording apparatus respectively. Positions, at which the plurality of ink cartridges are to be installed in a cartridge installing section, are designated for the plurality of ink cartridges in order to avoid any aggregation and any color mixture which would be otherwise caused by the mixing of inks.

When the ink contained in the ink cartridge is consumed, then a user removes the ink cartridge, and the user installs a new ink cartridge. As for the exchange of the ink cartridge as described above, for example, it is also assumed that a plurality of ink cartridges are simultaneously exchanged. When the ink cartridge is exchanged, then a cover of the cartridge installing section is opened, the ink cartridge, in which the ink has been consumed, is removed from the cartridge installing section, and a new ink cartridge is installed to the cartridge installing section. When all of the plurality of ink cartridges to be exchanged are exchanged, the cover of the cartridge installing section is closed.

When the ink cartridge is installed/removed with respect to the cartridge installing section, an ink supply tube of the cartridge installing section is inserted/extracted with respect to an ink supply port of the ink cartridge. In this procedure, it is feared that the ink may be scattered from the ink supply port and/or the ink supply tube. If the scattered ink flies to the outside of the cartridge installing section, for example, it is feared that a desk on which the printer is installed and surrounding objects may be dirtied.

On the other hand, casings of the ink cartridges, which have the same shape, are used even when the inks, which have different colors and/or which are of different types, are stored for the reason of the reduction of the production cost etc. The casings are constructed in many cases such that the colors and the types of the inks can be distinguished by sticking labels having different colors and/or indications. Therefore, if a user erroneously recognizes the label, it is assumed that the ink cartridge may be installed to any position different from the original position in the cartridge installing section.

Further, for example, it is also assumed that an ink cartridge having a narrow width may be erroneously installed to a position to which an ink cartridge having a wide width is to be installed, when the width of the casing of the cartridge differs depending on the ink amount capable of being stored. If the ink cartridge is installed to any erroneous position in the cartridge installing section as described above, the color mixture and the aggregation of inks may arise. If the color mixture and the aggregation of inks arise, it is necessary to perform the cleaning operation in order to dissolve such situations. The ink amount, which is consumed for the cleaning, is increased.

SUMMARY OF THE INVENTION

The present teaching has been made taking the foregoing circumstances into consideration, an object of which is to provide means for suppressing the scattering of a printing fluid to the outside of an apparatus when a printing fluid cartridge is installed/extracted.

Another object of the present teaching is to provide means for avoiding any erroneous installation of a printing fluid cartridge in a recording apparatus to which a plurality of printing fluid cartridges can be installed.

According to a first aspect of the present teaching, there is provided a recording apparatus which is configured to receive a plurality of printing fluid cartridges, the recording apparatus including: a printing section configured to perform printing by using printing fluids contained in the printing fluid cartridges; and a cartridge installing section configured to include: a case which is formed with an opening and which is configured to receive the printing fluid cartridges respectively via the opening; a flat plate-shaped lid which has a rotational shaft and which undergoes posture change to a closed posture to close the opening and an open posture to open the opening by being rotated around the rotational shaft; and printing fluid supply tubes each of which is provided on an ending surface of the case opposed to the opening and each of which is configured to be connectable to one of the printing fluid cartridges so that the printing fluid contained in the printing fluid cartridges is derived to the printing section, wherein: the lid has a curved section which is disposed on a side of one end in a widthwise direction along the rotational shaft and which is curved so that the one end is directed to a side of the ending surface of the case in a state in which the lid is in the closed posture; and the curved section is upstanding upwardly from a side of a bottom surface of the case in a state in which the lid is in the open posture.

The curved section of the lid is upstanding upwardly from the bottom surface side in the state in which the lid is in the open posture. Therefore, the printing fluid, which is scattered from the printing fluid supply tube, is suppressed from scattering to the outside of the lid owing to the curved section.

According to a second aspect of the present teaching, there is provided a printing fluid cartridge set which is configured to be installable to the cartridge installing section of the recording apparatus as defined in the first aspect, the printing fluid cartridge set including: a first printing fluid cartridge which is configured to be installable to a first position disposed nearest to the one end side of the case; and a second printing fluid cartridge which is configured to be installable to a second position different from the first position of the case, wherein: the first printing fluid cartridge has a box-shaped form which has an upper wall, a bottom wall, a front wall which passes through the opening at first under a condition that the first printing fluid cartridge is inserted into the case, a back wall which passes through the opening at last under the condition that the first printing fluid cartridge is inserted into the case, and side walls to connect the front wall and the back wall, and the first printing fluid cartridge has a first corner portion, which is formed by the back wall and the side wall disposed on the one end side, and which is chamfered so that the first corner portion does not abut against the curved section in the state in which the lid is in the closed state; and the second printing fluid cartridge has a box-shaped form which has an upper wall, a bottom wall, a front wall which passes through the opening at first under a condition that the second printing fluid cartridge is inserted into the case, a back wall which passes through the opening at last under the condition that the second printing fluid cartridge is inserted into the case, and side walls to connect the front wall and the back wall, and the second printing fluid cartridge has a second corner portion, which is formed by the back wall and the side wall disposed on the one end side, and which is not chamfered.

According to the printing fluid cartridge set of the second aspect of the present teaching, it is possible to avoid any erroneous installation of the first printing fluid cartridge and the second printing fluid cartridge to the cartridge installing section.

DESCRIPTION OF THE PREFERRED EMBODIMENTS

An embodiment of the present teaching will be explained below appropriately with reference to the drawings. The embodiment described below is merely an example in which the present teaching is embodied. It goes without saying that the embodiment can be appropriately changed within a range without changing the gist or essential characteristics of the present teaching.

<Outline of Printer 10>

Figure 1:
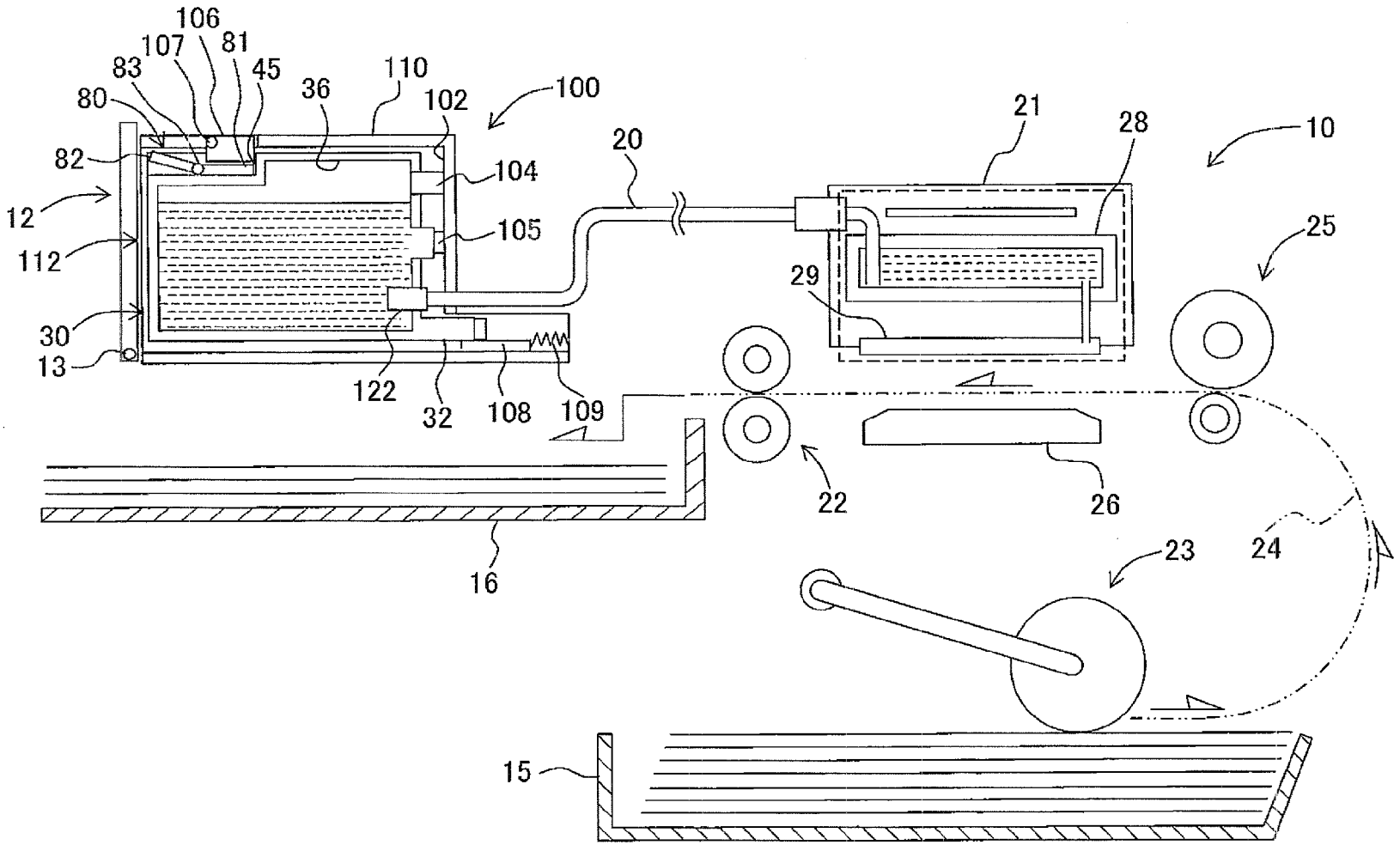
FIG. 1 shows a schematic sectional view schematically illustrating an internal structure of a printer provided with a cartridge installing section as an embodiment of the present teaching.

As shown in FIG. 1, a printer 10 records an image by discharging ink droplets from a recording head 21 to the recording paper. The printer 10 is provided with an ink supply apparatus 100. A cartridge installing section 110 is provided in the ink supply apparatus 100. A plurality of ink cartridges 30B, 30CL may be installed to the cartridge installing section 110. An opening 112, which has one surface thereof open to the outside, is formed for the cartridge installing section 110. The plurality of ink cartridges 30B, 30CL are inserted into the cartridge installing section 110 via the opening 112 respectively, or the plurality of ink cartridges 30B, 30CL are removed or extracted from the cartridge installing section 110 respectively.

Inks, which can be used in the printer 10, are stored in the ink cartridges 30B, 30CL. A pigment-based black ink is stored in the ink cartridge 30B. Dye-based inks of respective colors of cyan, magenta, and yellow are stored in the three ink cartridges 30CL respectively. The ink cartridges 30B, 30CL and the recording head 21 are connected by ink tubes 20 in a state in which the ink cartridges 30B, 30CL are installed to the cartridge installing section 110. Subtanks 28 are provided for the recording head 21. The subtanks 28 temporarily store the inks supplied via the ink tubes 20. The recording head 21 selectively discharges, from nozzles 29, the inks supplied from the subtanks 28 in accordance with the ink-jet recording system.

The recording paper, which is fed from a paper feed tray 15 to a transport passage 24 by a paper feed roller 23, is transported onto a platen 26 by a pair of transport rollers 25. The recording head 21 selectively discharges the inks of the respective colors with respect to the recording paper allowed to pass over the platen 26. Accordingly, the image is recorded on the recording paper. The recording paper, which has passed along the platen 26, is discharged to a paper discharge tray 16 provided on the most downstream side of the transport passage 24 by means of a pair of discharge rollers 22.

The schematic arrangement of the printer 10 according to this embodiment is merely an example of the recording apparatus. It goes without saying that other structures or arrangements concerning any known ink-jet printer may be adopted, for example, for the paper feed system and the paper transport system for the recording paper as well as the shape of the transport passage.

<Ink Supply Apparatus 100>

As shown in FIG. 1, the ink supply apparatus 100 is provided with the cartridge installing section 110 to which the ink cartridges 30B, 30CL can be installed. FIG. 1 shows a state in which the ink cartridge 30B is installed to the cartridge installing section 110. The ink cartridge 30B corresponds to the first printing fluid cartridge. The ink cartridge 30CL corresponds to the second printing fluid cartridge.

<Ink Cartridge 30*b*>

As shown in FIG. 1, the ink cartridge 30B has, for example, at least an ink chamber 36 in which the ink is stored. The black ink is stored in a space formed at the inside of the ink cartridge 30B. The ink chamber 36 may be, for example, a space formed by a casing 31 which forms the external appearance of the ink cartridge 30B. Alternatively, the ink chamber 36 may be a space formed by a member which is distinct from the casing 31 and which is formed at the inside of the casing 31.

Figure 2:
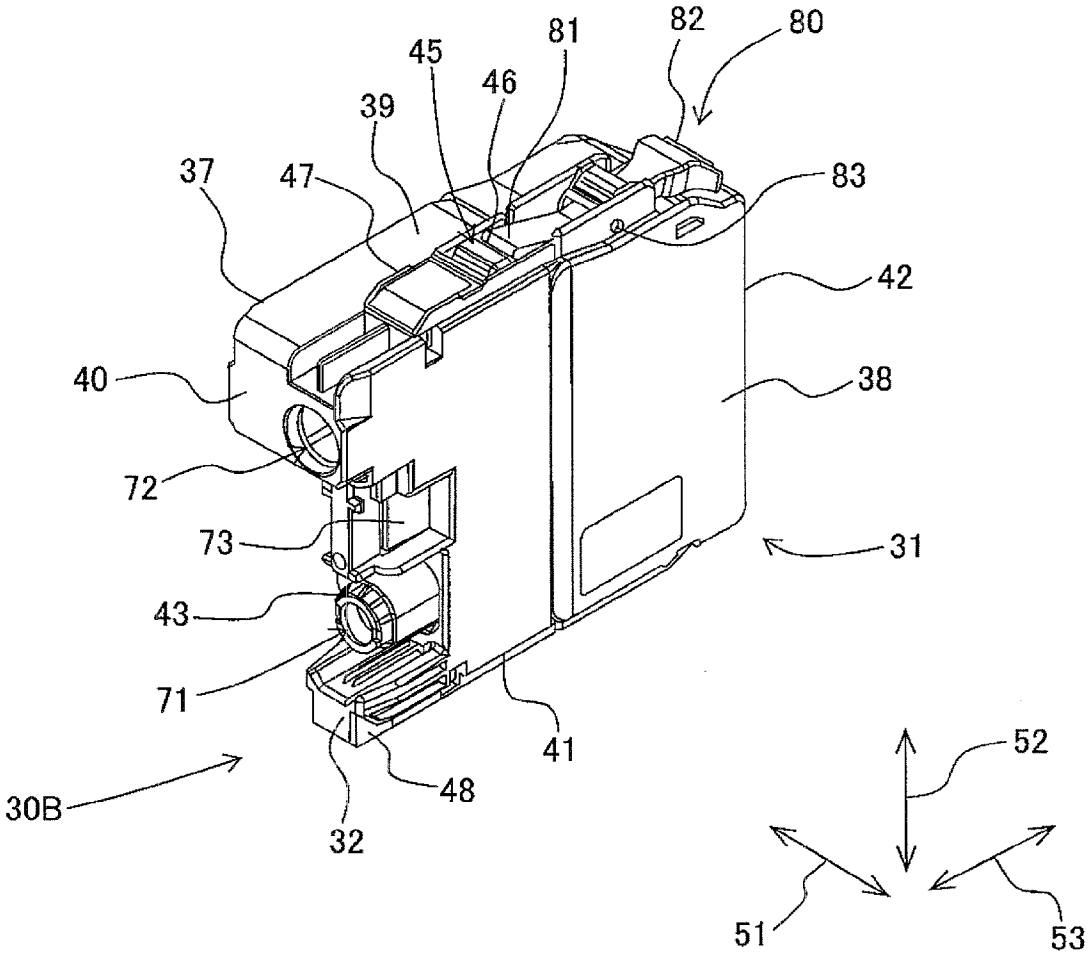
FIG. 2 shows a perspective view illustrating an external structure of a black ink cartridge of the embodiment of the present teaching.
Figure 8:
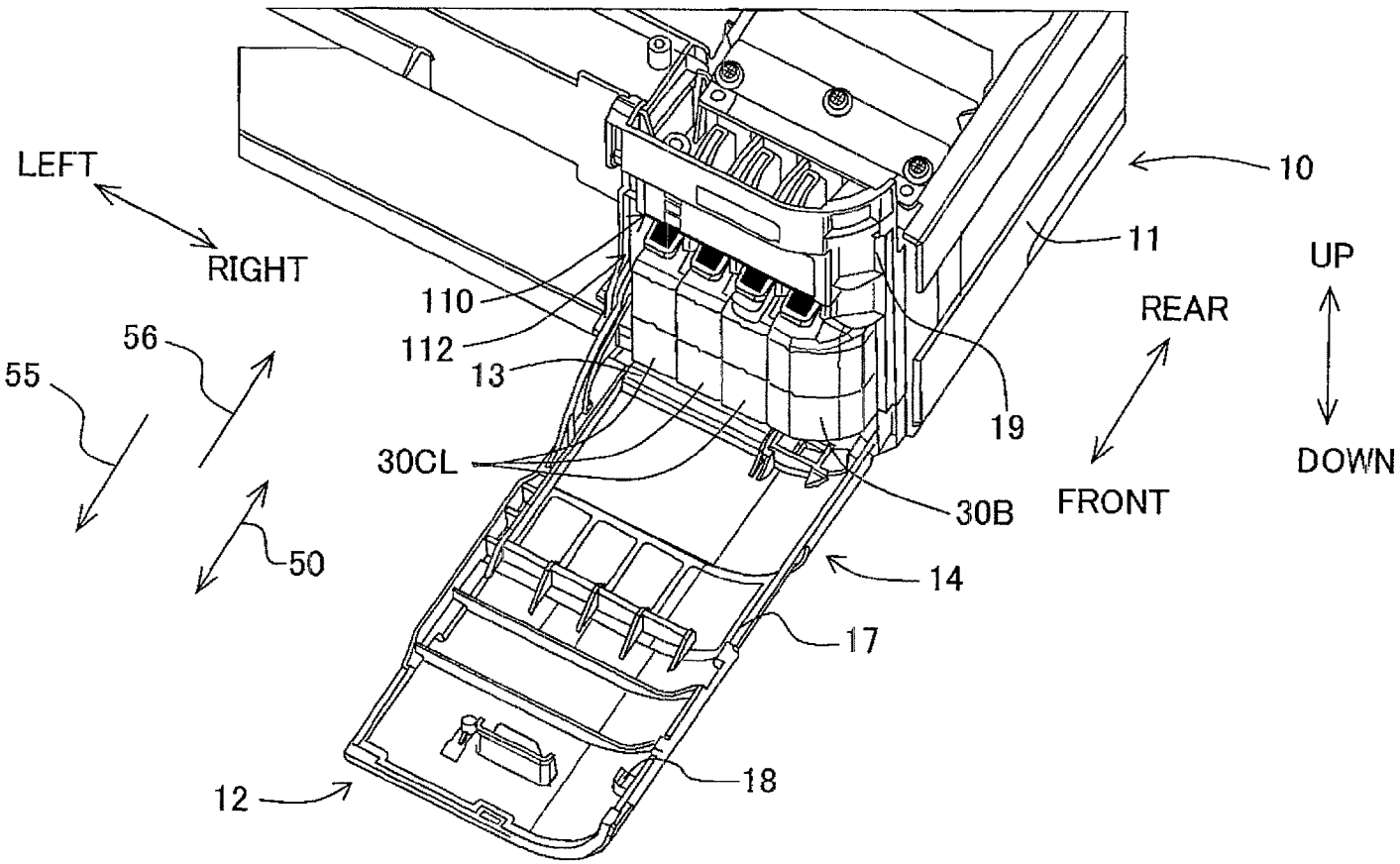
FIG. 8 shows a perspective view illustrating an external appearance to depict an arrangement of the cartridge installing section of the embodiment of the present teaching.

The ink cartridge 30B is usable in an upstanding state shown in FIG. 2, i.e., in such a state that the surface, which is disposed on the lower side in the drawing, is the lower surface (lower wall 41) and the surface, which is disposed on the upper side in the drawing, is the upper surface (upper wall 39), wherein an ink supply section 43 is arranged on the lower side of a front wall 40, and the ink cartridge 30B is inserted or removed in the direction indicated by an arrow 50 (hereinafter referred to as "insertion and removal direction 50", see FIG. 8) with respect to the cartridge installing section 110. That is, the ink cartridge 30B is inserted into the cartridge installing section 110 in the insertion and removal direction 50 in the upstanding state, and the ink cartridge 30B is extracted or removed from the cartridge installing section 110 in the insertion and removal direction 50 in the upstanding state. The upstanding state corresponds to the installation posture as the posture in which the ink cartridge 30B is installed to the cartridge installing section 110. As shown in FIG. 8, the orientation, in which the ink cartridge 30B is inserted into the cartridge installing section 110, is the insertion orientation 56. The orientation, in which the ink cartridge 30B is extracted or withdrawn (removed) from the cartridge installing section 110, is the removal orientation 55. The insertion orientation 56 and the removal orientation 55 are parallel to the insertion and removal direction 50. In this embodiment, the insertion orientation 56 and the removal orientation 55 extend in the horizontal direction.

Figure 3:
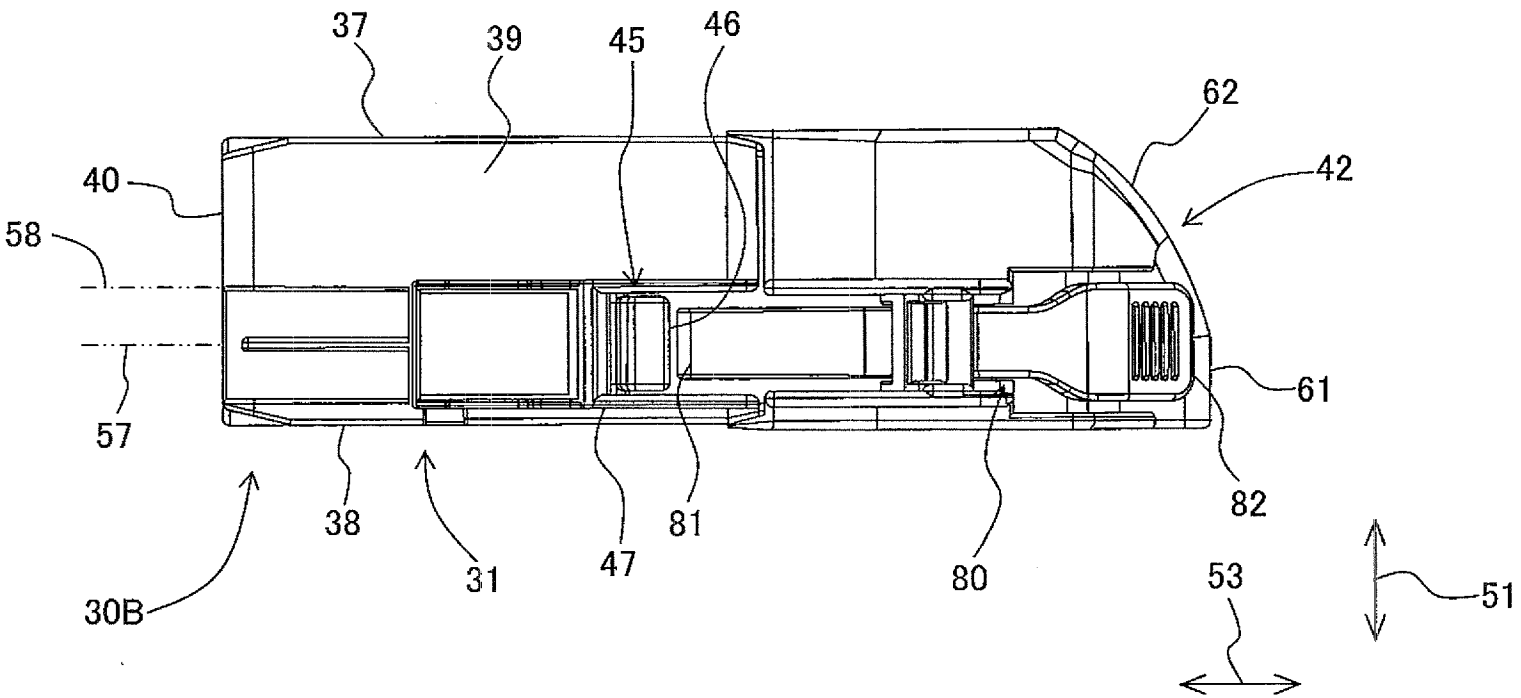
FIG. 3 shows a top view illustrating the external structure of the black ink cartridge of the embodiment of the present teaching.
Figure 4:
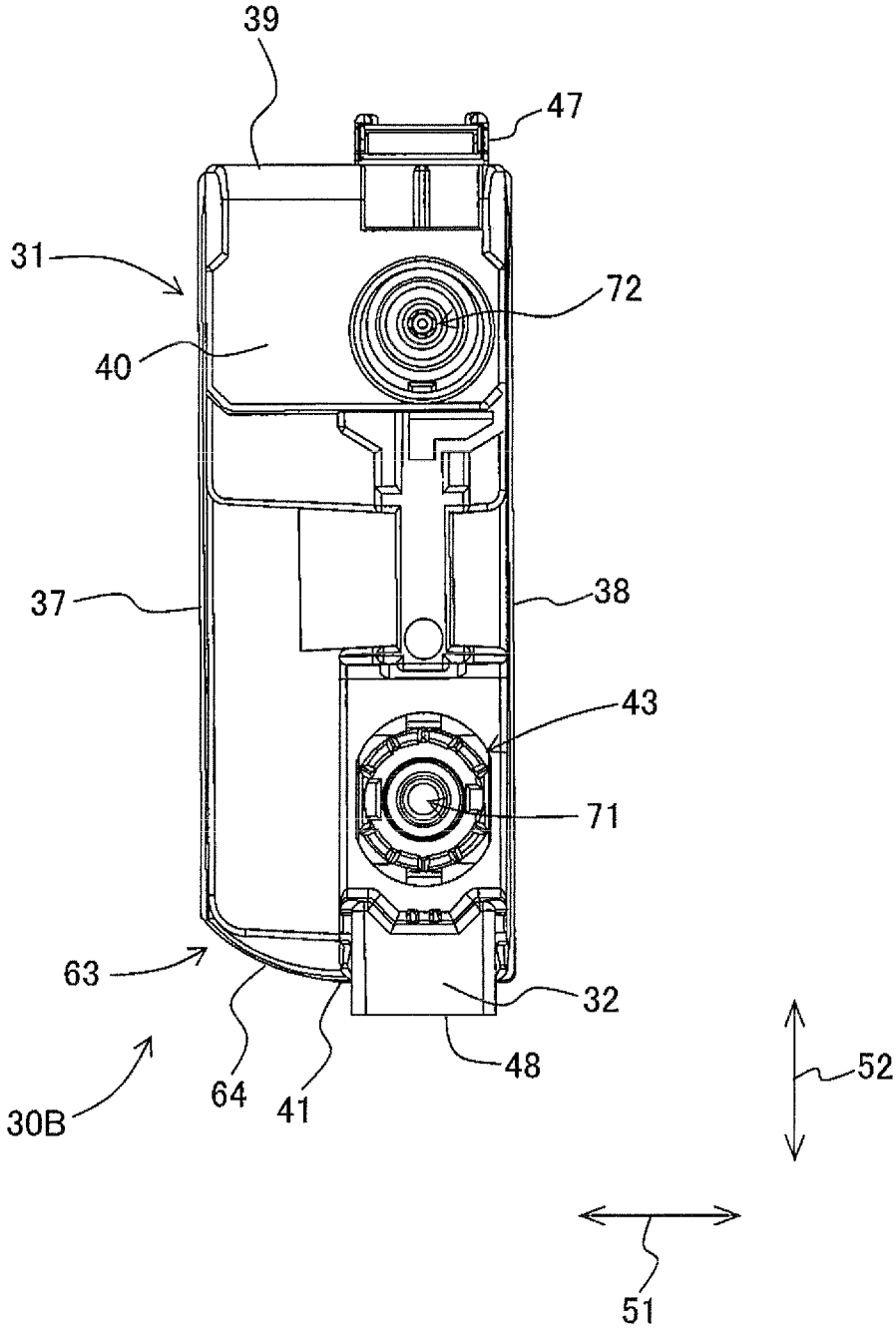
FIG. 4 shows a front view illustrating the external structure of the black ink cartridge of the embodiment of the present teaching.

As shown in FIGS. 2 to 4, the ink cartridge 30B has the casing 31 having, for example, a substantially rectangular parallelepiped-shaped form. The casing 31 has, for example, such a flat shape that the dimension in the widthwise direction 51 is short, and the dimensions in the height direction 52 and the front-hack direction 53 are longer than the dimension in the widthwise direction 51. The widthwise direction 51 and the front-back direction 53 extend along the horizontal direction when the ink cartridge 30B is in the installation posture. The height direction 52 extends in the vertical direction when the ink cartridge 30B is in the installation posture. When the ink cartridge 30B is inserted into or removed from the cartridge installing section 110, then the front-back direction 53 is parallel to the insertion and removal direction 50, and the widthwise direction 51 and the height direction 52 are perpendicular to the insertion and removal direction 50.

The casing 31 has a front wall 40 which is disposed on the front side in the insertion orientation 56 and a back wall 42 which is disposed on the back side in the insertion orientation 56. The front wall 40 is the wall of the casing 31 disposed on the front side in the insertion orientation 56 when the ink cartridge 30B is inserted into the cartridge installing section 110, and the back wall 42 is the wall of the casing 31 disposed on the back side. The front wall 40 and the back wall 42 are arranged while being separated from each other by a predetermined distance in the front-back direction 53 (insertion and removal direction 50). Further, the casing 31 has a pair of side walls 37, 38 which connect the front wall 40 and the back wall 42 and which extend in the insertion and removal direction 50. The side walls 37, 38 may be positioned while being separated from each other by a predetermined distance in the widthwise direction 51. Further, the casing 31 may have an upper wall 39 which connects the side walls 37, 38, the front wall 40, and the back wall 42 and which extends from the upper end of the front wall 40 to the upper end of the back wall 42, and a lower wall 41 which extends from the lower end of the front wall 40 to the lower end of the back wall 42. The upper wall 39 and the lower wall 41 may be positioned while being separated from each other by a predetermined distance in the height direction 52.

As shown in FIG. 2, the ink supply section 43 is provided, for example, on the lower side in the height direction 52 of the front wall 40 of the casing 31. As shown in FIG. 3, the center 57 of the ink supply section 43 is arranged while being offset (deviated), for example, toward the right side (front side of the paper surface in relation to FIG. 2) with respect to the center 58 in the widthwise direction 51 of the front wall 40. The offset of the arrangement of the ink supply section 43 as described above is useful in order to provide the common arrangement of the ink supply section 43 with respect to an ink supply tube 122 (see FIG. 9) described later on even when the shape in the widthwise direction of the ink cartridge 30B is changed in order to increase the ink capacity (volume). For example, the ink cartridge 30CL, which has a front wall 140 having a shorter dimension in the widthwise direction 51 as compared with the front wall 40 of the ink cartridge 30B, has a small volume of an internal space of a casing 131 as well, and hence the ink capacity (volume) is small. In the case of the ink cartridge 30CL having the small capacity (volume) as described above, it is preferable that the center of the ink supply section 143 is coincident with the center in the widthwise direction of the front wall 140.

The ink supply section 43 has, for example, a cylindrical outer shape. The ink supply section 43 protrudes in the orientation to make separation from the ink chamber 36 along the front-back direction 53 (insertion and removal direction 50) from the front wall 40, i.e., in the insertion orientation 56. An ink supply port 71 is formed to be open, for example, in the vicinity of the forward end of the ink supply section 43. Although not shown in the respective drawings, an ink flow passage is formed at the inside of the ink supply section 43. The ink flow passage extends in the front-back direction 53 from the ink supply port 71 to make communication with the ink chamber 36.

Although not shown in the respective drawings, the ink supply port 71 is constructed openably/closably, for example, by means of a valve. The valve is provided movably in the front-back direction 53 in the ink flow passage of the ink supply section 43. The valve is urged toward the ink supply port 71 by means of a coil spring. Therefore, the valve is positioned at the closed position at which the valve closes the ink supply port 71 in a liquid-tight manner in a state in which no external force is exerted on the valve. A portion of the forward end of the ink supply section 43, which surrounds the ink supply port 71, is formed of, for example, an elastic member such as rubber or the like. When the urged valve is brought in contact with the elastic member, then the elastic member is elastically deformed, and the ink supply port 71 is closed in the liquid-tight manner. In this state, a part of the valve is exposed to the outside of the ink supply section 43 from the ink supply port 71, i.e., to the outside of the ink cartridge 30B. Neither the valve nor the coil spring is essential. A film or a rubber plug may be provided in place of the valve.

When the ink cartridge 30B is installed to the cartridge installing section 110, the ink supply tube 122 (see FIG. 9), which is provided for the cartridge installing section 110, is inserted into the ink supply port 71. Accordingly, the coil spring is elastically deformed, and the valve is moved to the open position separated from the ink supply port 71 against the urging action of the coil spring.

An atmospheric air communication port 72 is provided on the upper side of the front wall 40 of the casing 31. The atmospheric air communication port 72 is provided in order to introduce the atmospheric air into the ink chamber 36 as the ink outflows from the ink chamber 36 into the ink supply tube 122 provided for the cartridge installing section 110. The atmospheric air communication port 72 may be opened/closed, for example, by means of a valve in the same manner as the ink supply section 43 described above. Alternatively, the atmospheric air communication port 72 may be always open to the outside of the casing 31, for example, by means of a labyrinth structure. The atmospheric air communication port 72 is not essential. For example, the ink chamber 36 may be formed with a bag, and the pressure in the ink chamber 36 may be lowered in accordance with the decrease in the ink.

A detecting section 73 is provided at a central portion in the height direction 52 of the front wall 40 of the casing 31 in order to detect or sense the remaining amount of the ink in the ink chamber 36. The detecting section 73 is a protrusion which protrudes in the direction to make separation from the ink chamber 36 from the upper side of the ink supply section 43 of the front wall 40 of the ink cartridge 30B. The detecting section 73 has the light-transmissive property. Therefore, the remaining amount of the ink can be visually recognized by observing the inside of the ink chamber 36 from the outside via the detecting section 73. Further, the light is radiated to the detecting section 73 from a light-emitting element of an optical sensor, the light transmitted through the detecting section 73 is received by a light-receiving element, and the remaining amount of the ink can be judged depending on whether or not the amount of received light is not less than a threshold value. A light shielding plate, which cooperates with a float that is movable depending on the liquid surface of the ink chamber 36, may be provided in the detecting section 73. In place of the light shielding plate, it is also allowable to provide any component or member to lower the light amount which arrives at a light-receiving element by reflecting, diffracting, or attenuating all or a part of the light which goes from a light-emitting element depending on whether or not the liquid surface in the ink chamber 36 is brought in contact with the detecting section 73.

As shown in FIGS. 2 to 4, a projection 32, which protrudes, for example, in the insertion orientation 56, is provided at the lower end of the front wall 40 of the casing 31. The projection 32 protrudes to the front side as compared with the protruding end of the ink supply section 43 provided on the front wall 40.

As shown in FIGS. 2 and 4, a guide section 47, which protrudes, for example, upwardly, is provided on the upper wall 39 of the casing 31. The guide section 47 is a protruding strip thinner than the size or dimension of the upper wall 39 in the widthwise direction 51. The guide section 47 extends in the front-back direction 53 between the front wall 40 and the back wall 42. A recess is formed by the upper wall and the side surfaces of the protruding strip. The center of the guide section 47 in the widthwise direction 51 is arranged while being offset, for example, toward the right side (right side of the paper surface of FIG. 4) with respect to the center of the upper wall 39 in the widthwise direction 51. The arrangement, in which the center of the guide section 47 in the widthwise direction 51 is not coincident with the center of the upper wall 39 in the widthwise direction 51, is useful to obtain the common arrangement of the guide section 47 with respect to a guide rail 114 (see FIG. 9) described later on even when the ink capacity (volume) of the ink cartridge 30B is changed, in the same manner as the offset arrangement of the ink supply section 43 described above.

As shown in FIGS. 2 and 4, a guide section 48, which protrudes downwardly, is provided on the lower wall 41 of the casing 31. The guide section 48 is a protruding strip thinner than the size or dimension of the lower wall 41 in the widthwise direction 51. The guide section 48 extends in the front-back direction 53 between the front wall 40 and the back wall 42. A recess is formed by the lower wall and the side surfaces of the protruding strip. The center of the guide section 48 in the widthwise direction 51 is arranged while being offset, for example, toward the right side (right side of the paper surface of FIG. 2) with respect to the center of the lower wall 41 in the widthwise direction 51. The arrangement, in which the center of the guide section 48 in the widthwise direction 51 is not coincident with the center of the lower wall 41 in the widthwise direction 51, is useful to obtain the common arrangement of the guide section 48 with respect to a guide rail 115 (see FIG. 9) described later on even when the ink capacity (volume) of the ink cartridge 30B is changed, in the same manner as the offset arrangement of the ink supply section 43 described above.

In this embodiment, the distance between the center in the widthwise direction 51 of each of the guide sections 47, 48 and the center in the widthwise direction 51 of the upper wall 39 or the lower wall 41 is approximately equivalent to the distance between the center 57 of the ink supply section 43 and the center 58 in the widthwise direction 51 of the front wall 40. In other words, the ink supply section 43 and the guide sections 47, 48 are arranged, for example, at the same position in the widthwise direction 51. When the ink cartridge 30B is viewed along the front-back direction 53 from the side of the front wall 40 (FIG. 4), the ink supply section 43 and the guide sections 47, 48 are arranged so that they are overlapped with each other in the widthwise direction 51.

As shown in FIGS. 2 and 3, a fastening section 45 is formed at a portion disposed in the vicinity of the center in the front-back direction 53 of the guide section 47. The fastening section 45 is a recess having a fastening surface 46 which is spread in the widthwise direction 51 and/or the height direction 52 of the ink cartridge 30B. An engaging member 106 described later on is engaged with the fastening surface 46 in a state in which the ink cartridge 30B is installed to the cartridge installing section 110.

As shown in FIGS. 2 and 3, a rotatable member 80 is provided, for example, on the side of the upper wall 39 disposed on the side of the back wall 42 of the casing 31. The rotatable member 80 is, for example, an L-shaped flat plate. The rotatable member 80 is arranged so that the longitudinal direction thereof extends along the front-back direction 53. The rotatable member 80 has a shaft 83 which extends in the widthwise direction 51 and which is disposed at a position of being bent between a forward end portion 81 and a backward end portion 82. The rotatable member 80 is rotatable about the shaft 83.

The forward end portion 81 of the rotatable member 80, which is disposed on the side of the front wall 40, is arranged, for example, in the vicinity of the fastening surface 46. The backward end portion 82 of the rotatable member 80 slightly protrudes, for example, from the back wall 42. In a state in which any external force is not applied to the forward end portion 81 of the rotatable member 80, the rotatable member 80 is urged by the self-weight or a coil spring, and the forward end portion 81 is positioned on the uppermost side of the fastening section 45. In this situation, the forward end portion 81 protrudes upwardly from the fastening section 45. In this state, the backward end portion 82 approaches the upper wall 39 of the casing 31 most closely. When the forward end portion 81 of the rotatable member 80 is depressed downwardly toward the bottom of the fastening section 45, the rotatable member 80 is rotated counterclockwise, for example, as viewed in FIG. 2 against the self-weight. When the backward end portion 82 of the rotatable member 80 is depressed downwardly, the rotatable member 80 is rotated clockwise as viewed in FIG. 2.

As shown in FIG. 3, the back wall 42 has, in the widthwise direction 51, a first surface 61 which is arranged opposingly to the ink supply section 43 in the front-back direction 53, and a second surface 62 which is offset in the widthwise direction 51 with respect to the ink supply section 43. The first surface 61 is a flat surface perpendicular to the front-back direction 53, which may be wide in the width as compared with the size or dimension in the widthwise direction 51 of the ink supply section 43. The first surface 61 is a flat surface which is continued to the upper wall 39 and the lower wall 41.

The second surface 62 is a curved surface which is arranged while being inclined with respect to the front-back direction 53, for example, from the first surface 61 toward the front wall 40, and which is not perpendicular to the front-back direction 53. The second surface 62 is continued to the upper wall 39 and the lower wall 41, and the second surface 62 is continued to the first surface 61 and the side wall 37. As a result of the formation of the second surface 62, the casing 31 has the corner portion (first corner portion) which is chamfered and which is disposed along the height direction 52 of the back wall 42. The shape of the curved surface as the second surface 62 is provided along the inner surface shape of a curved section 14 of a lid 12 as described later on.

As shown in FIG. 4, a corner portion 63 (third corner portion) extending in the front-back direction 53, along which the side wall 37 and the lower wall 41 are continued, has a curved surface 64 which is formed by being chamfered. The shape of the curved surface 64 extends along the inner surface shape of the curved section 14 of the lid 12 as described later on. Since the corner portion 63 is chamfered, the corner portion 63 of the ink cartridge 30B inserted into a case 101 does not abut against the curved section 14 of the lid 12 when the lid 12 is in the open posture as described later on.

<Ink Cartridge 30CL>

Each of the ink cartridges 30CL has, for example, an ink chamber in which at least the ink is stored. The ink of any one of the colors of cyan, magenta, and yellow is stored in a space formed at the inside of the ink cartridge 30CL. The three ink cartridges 30CL have the same or equivalent structure except that the color of the ink stored in the internal space differs. Therefore, the detailed structure will be explained below as exemplified by one ink cartridge 30CL.

Figure 5:
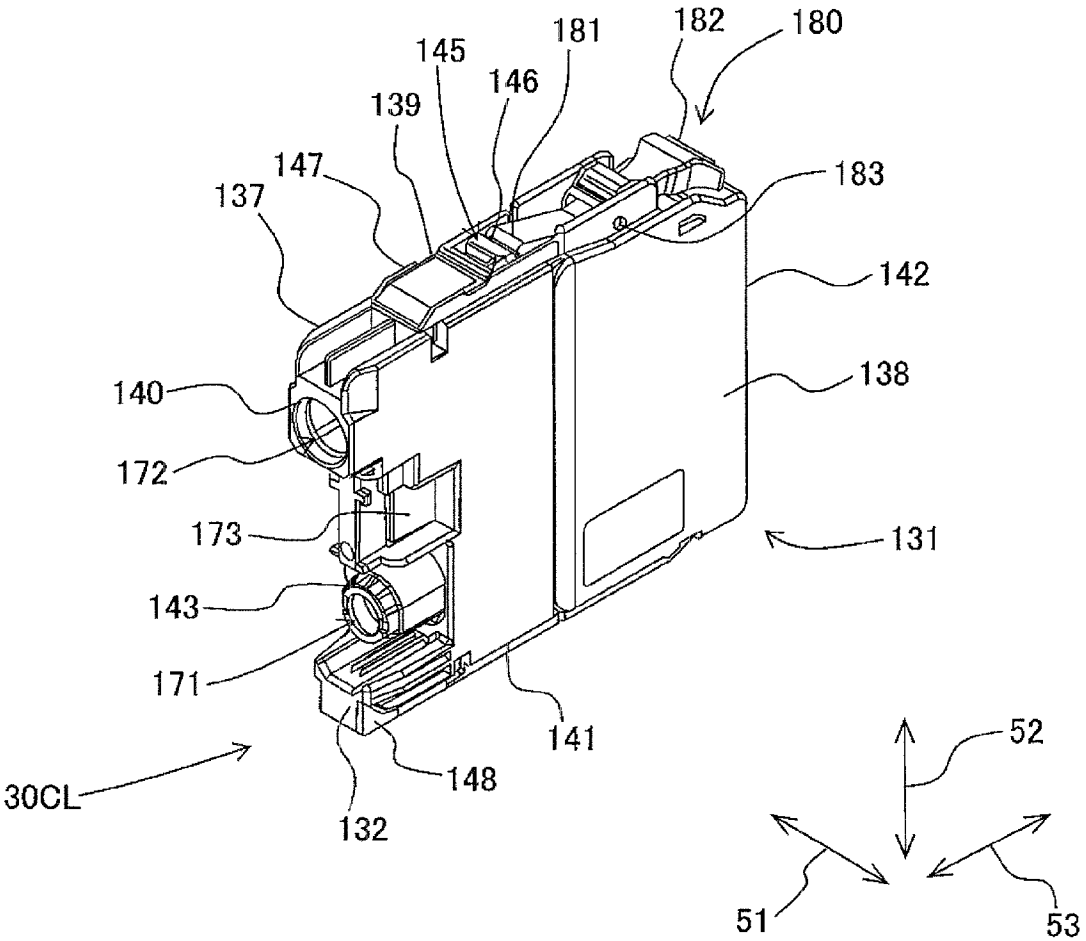
FIG. 5 shows a perspective view illustrating an external structure of a color ink cartridge of the embodiment of the present teaching.

The ink cartridge 30CL is usable in an upstanding state shown in FIG. 5, i.e., in such a state that the surface, which is disposed on the lower side in the drawing, is the lower surface (lower wall 141) and the surface, which is disposed on the upper side in the drawing, is the upper surface (upper wall 139), wherein an ink supply section 143 is arranged on the lower side of a front wall 140, and the ink cartridge 30CL is inserted or removed in the direction indicated by the arrow 50 (hereinafter referred to as "insertion and removal direction 50", see FIG. 8) with respect to the cartridge installing section 110. That is, the ink cartridge 30CL is inserted into the cartridge installing section 110 in the insertion and removal direction 50 in the upstanding state, and the ink cartridge 30CL is extracted (removed) from the cartridge installing section 110 in the insertion and removal direction 50 in the upstanding state. The upstanding state corresponds to the installation posture as the posture in which the ink cartridge 30CL is installed to the cartridge installing section 110. As shown in FIG. 8, the orientation, in which the ink cartridge 30CL is inserted into the cartridge installing section 110, is the insertion orientation 56. The orientation, in which the ink cartridge 30CL is extracted or withdrawn (removed) from the cartridge installing section 110, is the removal orientation 55.

The ink cartridge 30CL has the casing 131 having, for example, a substantially rectangular parallelepiped-shaped form. The casing 131 has, for example, such a flat shape that the dimension in the widthwise direction 51 is short, and the dimensions in the height direction 52 and the front-back direction 53 are longer than the dimension in the widthwise direction 51. The casing 131 of the ink cartridge 30CL is shorter in the widthwise direction 51 than the casing 31 of the ink cartridge 30B. However, the casing 131 of the ink cartridge 30CL has the equivalent dimensions in the height direction 52 and the front-back direction 53. In other words, the width of the casing 131 is narrower than that of the casing 31.

The casing 131 has a front wall 140 which is disposed on the front side in the insertion orientation 56 and a back wall 142 which is disposed on the back side in the insertion orientation 56. The front wall 140 is the wall of the casing 131 disposed on the front side in the insertion orientation 56 when the ink cartridge 30CL is inserted into the cartridge installing section 110, and the back wall 142 is the wall of the casing 131 disposed on the back side. The front wall 140 and the back wall 142 are arranged while being separated from each other by a predetermined distance in the front-back direction 53 (insertion and removal direction 50). Further, the casing 131 has a pair of side walls 137, 138 which connect the front wall 140 and the back wall 142 and which extend in the insertion and removal direction 50. The side walls 137, 138 may be positioned while being separated from each other by a predetermined distance in the widthwise direction 51. Further, the casing 131 may have an upper wall 139 which connects the side walls 137, 138, the front wall 140, and the back wall 142 and which extends from the upper end of the front wall 140 to the upper end of the back wall 142, and a lower wall 141 which extends from the lower end of the front wall 140 to the lower end of the hack wall 142. The upper wall 139 and the lower wall 141 may be positioned while being separated from each other by a predetermined distance in the height direction 52.

As shown in FIG. 5, the ink supply section 143 is provided, for example, on the lower side in the height direction 52 of the front wall 140 of the casing 131. The center 157 of the ink supply section 143 is arranged while being coincident with the center 158 in the widthwise direction 51 of the front wall 140.

The ink supply section 143 has, for example, a cylindrical outer shape. The ink supply section 143 protrudes in the orientation to make separation from the ink chamber along the front-back direction 53 (insertion and removal direction 50) from the front wall 140, i.e., in the insertion orientation 56. An ink supply port 171 is formed to be open, for example, in the vicinity of the forward end of the ink supply section 143. Although not shown in the respective drawings, an ink flow passage is formed at the inside of the ink supply section 143. The ink flow passage extends in the front-back direction 53 from the ink supply port 171 to make communication with the ink chamber.

Although not shown in the respective drawings, the ink supply port 171 is constructed openably/closably, for example, by means of a valve in the same manner as in the ink cartridge 30B. Alternatively, the ink supply port 171 is constructed so that the ink flow passage is openable/closable, for example, by means of a film or a rubber plug. When the ink cartridge 30CL is installed to the cartridge installing section 110, the ink supply tube 122 (see FIG. 9), which is provided for the cartridge installing section 110, is inserted into the ink supply port 171. Accordingly, the valve is opened, and the ink supply port 171 is opened.

An atmospheric air communication port 172 is provided on the upper side of the front wall 140 of the casing 131. The atmospheric air communication port 172 is provided in order to introduce the atmospheric air into the ink chamber as the ink outflows from the ink chamber into the ink supply tube 122 provided for the cartridge installing section 110. The atmospheric air communication port 172 may be opened/closed, for example, by means of a valve in the same manner as the ink supply section 143 described above. Alternatively, the atmospheric air communication port 172 may be always open to the outside of the casing 131, for example, by means of a labyrinth structure. The atmospheric air communication port 172 is not essential. For example, the ink chamber may be formed with a bag, and the pressure in the ink chamber may be lowered in accordance with the decrease in the ink.

A detecting section 173 is provided at a central portion in the height direction 52 of the front wall 140 of the casing 131 in order to detect or sense the remaining amount of the ink in the ink chamber. The detecting section 173 is a protrusion which protrudes in the direction to make separation from the ink chamber from the upper side of the ink supply section 143 of the front wall 140 of the ink cartridge 30CL. The detecting section 173 has the light-transmissive property. Therefore, the remaining amount of the ink can be visually recognized by observing the inside of the ink chamber from the outside via the detecting section 173. Further, the light is radiated to the detecting section 173 from a light-emitting element of an optical sensor, the light transmitted through the detecting section 173 is received by a light-receiving element, and the remaining amount of the ink can be judged depending on whether or not the amount of received light is not less than a threshold value. A light shielding plate, which cooperates with a float that is movable depending on the liquid surface of the ink chamber, may be provided in the detecting section 173. In place of the light shielding plate, it is also allowable to provide any component or member to lower the light amount which arrives at a light-receiving element by reflecting, diffracting, or attenuating all or a part of the light which goes from a light-emitting element depending on whether or not the liquid surface in the ink chamber is brought in contact with the detecting section 173.

Figure 6:
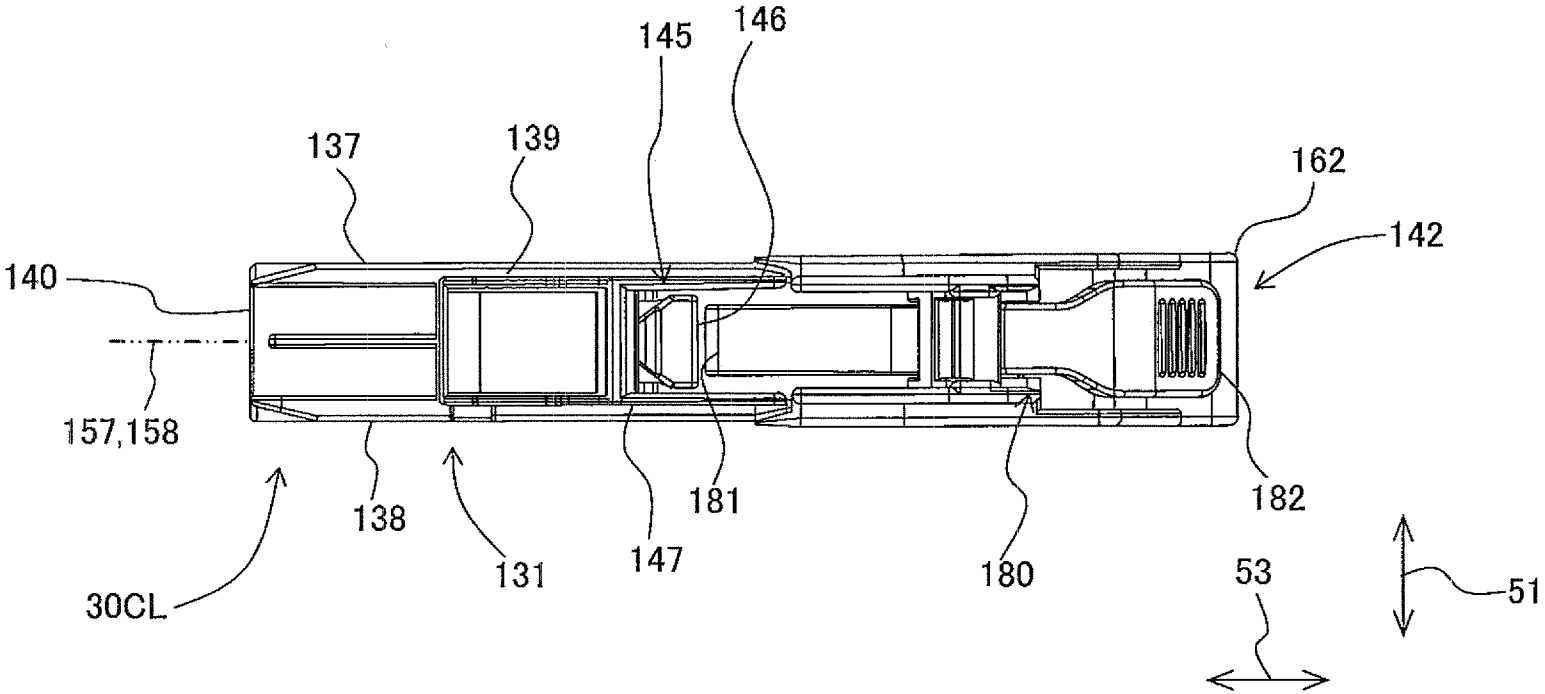
FIG. 6 shows a top view illustrating the external structure of the color ink cartridge of the embodiment of the present teaching.

As shown in FIGS. 5 to 6, a projection 132, which protrudes, for example, in the insertion orientation 56, is provided at the lower end of the front wall 140 of the casing 131. The projection 132 protrudes to the front side as compared with the protruding end of the ink supply section 143 provided on the front wall 140.

Figure 7:
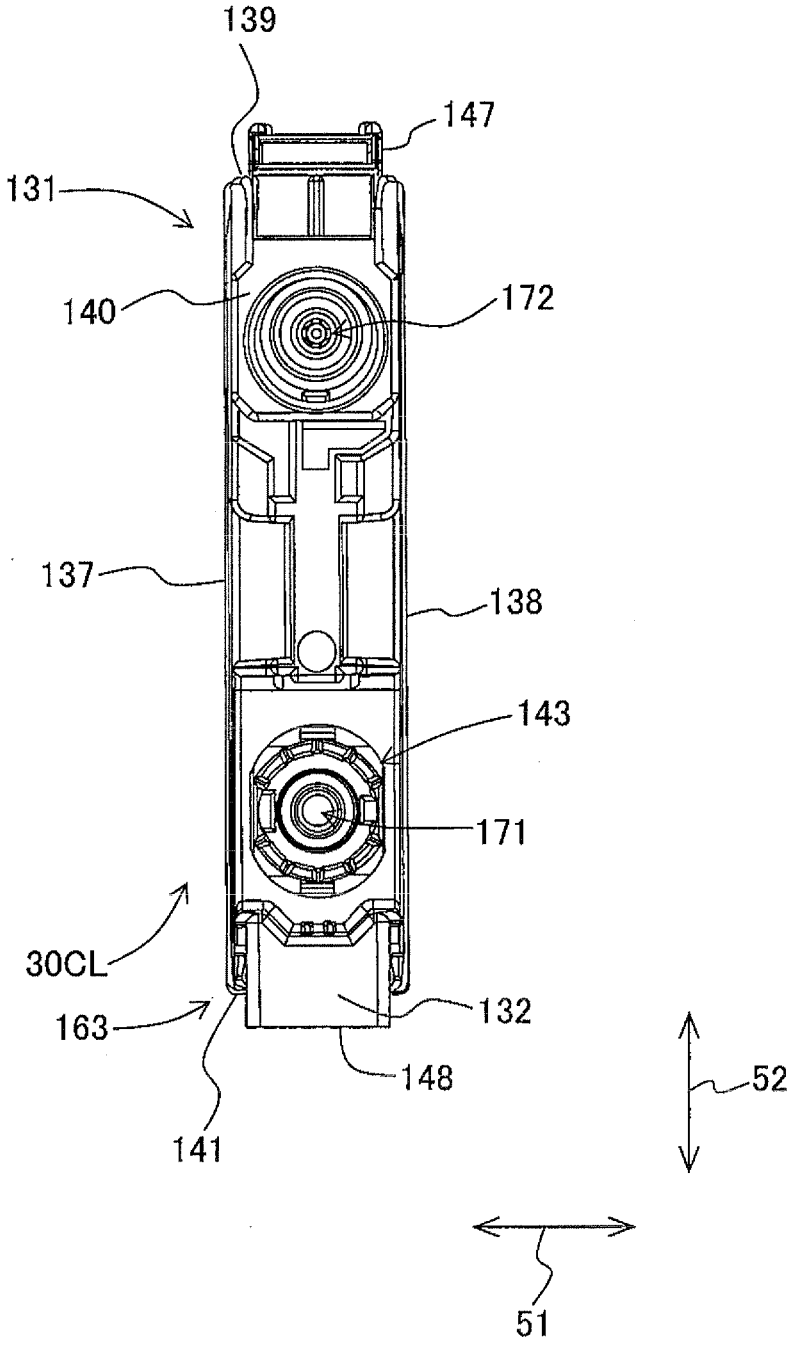
FIG. 7 shows a front view illustrating the external structure of the color ink cartridge of the embodiment of the present teaching.

As shown in FIGS. 5 and 7, a guide section 147, which protrudes, for example, upwardly, is provided on the upper wall 139 of the casing 131. The guide section 147 is a protruding strip thinner than the size or dimension of the upper wall 139 in the widthwise direction 51. The guide section 147 extends in the front-back direction 53 between the front wall 140 and the back wall 142. A recess is formed by the upper wall and the side surfaces of the protruding strip. The center of the guide section 147 in the widthwise direction 51 is arranged while being coincident with the center of the upper wall 139 in the widthwise direction 51.

As shown in FIGS. 5 and 7, a guide section 148, which protrudes downwardly, is provided on the lower wall 141 of the casing 131. The guide section 148 is a protruding strip thinner than the size or dimension of the lower wall 141 in the widthwise direction 51. The guide section 148 extends in the front-back direction 53 between the front wall 140 and the back wall 142. A recess is formed by the lower wall and the side surfaces of the protruding strip. The center of the guide section 148 in the widthwise direction 51 is arranged while being coincident with the center of the lower wall 141 in the widthwise direction 51.

As shown in FIGS. 5 and 6, a fastening section 145 is formed at a portion disposed in the vicinity of the center in the front-back direction 53 of the guide section 147. The fastening section 145 is a recess having a fastening surface 146 which is spread in the widthwise direction 51 and/or the height direction 52 of the ink cartridge 30CL. An engaging member 106 described later on is engaged with the fastening surface 146 in a state in which the ink cartridge 30CL is installed to the cartridge installing section 110.

As shown in FIGS. 5 and 6, a rotatable member 180 is provided, for example, on the side of the upper wall 139 disposed on the side of the back wall 142 of the casing 131. The rotatable member 180 is, for example, an L-shaped flat plate. The rotatable member 180 is arranged so that the longitudinal direction thereof extends along the front-back direction 53. The rotatable member 180 has a shaft 183 which extends in the widthwise direction 51 and which is disposed at a position of being bent between a forward end portion 181 and a backward end portion 182. The rotatable member 180 is rotatable about the shaft 183.

The forward end portion 181 of the rotatable member 180, which is disposed on the side of the front wall 140, is arranged, for example, in the vicinity of the fastening surface 146. The backward end portion 182 of the rotatable member 180 slightly protrudes, for example, from the back wall 42. In a state in which any external force is not applied to the forward end portion 181 of the rotatable member 180, the rotatable member 180 is urged by the self-weight or a coil spring, and the forward end portion 181 is positioned on the uppermost side of the fastening section 145. In this situation, the forward end portion 181 protrudes upwardly from the fastening section 145. In this state, the backward end portion 182 approaches the upper wall 139 of the casing 131 most closely. When the forward end portion 181 of the rotatable member 180 is depressed downwardly toward the bottom of the fastening section 145, the rotatable member 180 is rotated counterclockwise, for example, as viewed in FIG. 5 against the self-weight. When the backward end portion 182 of the rotatable member 180 is depressed downwardly, the rotatable member 180 is rotated clockwise as viewed in FIG. 5.

As shown in FIG. 6, the back wall 142 is a flat surface which is opposed to the front wall 140 and which is continued to the side walls 137, 138, the upper wall 139, and the lower wall 141. A corner portion 162 (second corner portion), which is disposed along the height direction of the back wall 142, has an angulated shape without being chamfered. The corner portion 162 has a curvature radius smaller than that of the inner surface of the curved section 14 of the lid 12 as described later on, which is capable of abutting against the inner surface of the curved section 14. The curvature radius of the corner portion 162 is smaller than that of the second surface 62 of the ink cartridge 30B.

As shown in FIG. 7, a corner portion 163 (fourth corner portion) disposed along the front-back direction 53, at which the side wall 137 and the lower wall 141 are continued, has an angulated shape without being chamfered. The corner portion 163 has a curvature radius smaller than that of the inner surface of the curved section 14 of the lid 12 as described later on, which is capable of abutting against the inner surface of the curved section 14. The curvature radius of the corner portion 163 is smaller than that of the corner portion 63 (curved surface 64) of the ink cartridge 30B.

In this embodiment, the meanings of the phrase "the corner portion 63 and the corner portion disposed along with the height direction 52 of the back wall 42 are chamfered" and the phrase "the corner portion 163 and the corner portion 162 disposed along with the height direction of the back wall 142 are not chamfered" do not merely reside in a meaning to indicate whether or not the corner portion is processed to have the curvature radius. The phrases reside in a meaning to indicate whether or not the corner portion is chamfered to cause no abutment against the inner surface of the curved section 14 of the lid 12 in the open posture or the closed posture in relation to the inner surface shape of the curved section 14 of the lid 12. Therefore, when the inner surface shape of the curved section 14 of the lid 12 differs, then the corner portion abuts against the inner surface of the curved section 14 in some cases, or the corner portion does not abut against the inner surface of the curved section 14 in other cases. Therefore, it is judged whether or not the corner portion is chamfered in accordance with the relative relationship with respect to the inner surface shape of the curved section 14 of the lid 12.

<Cartridge Installing Section 110>

Figure 9:
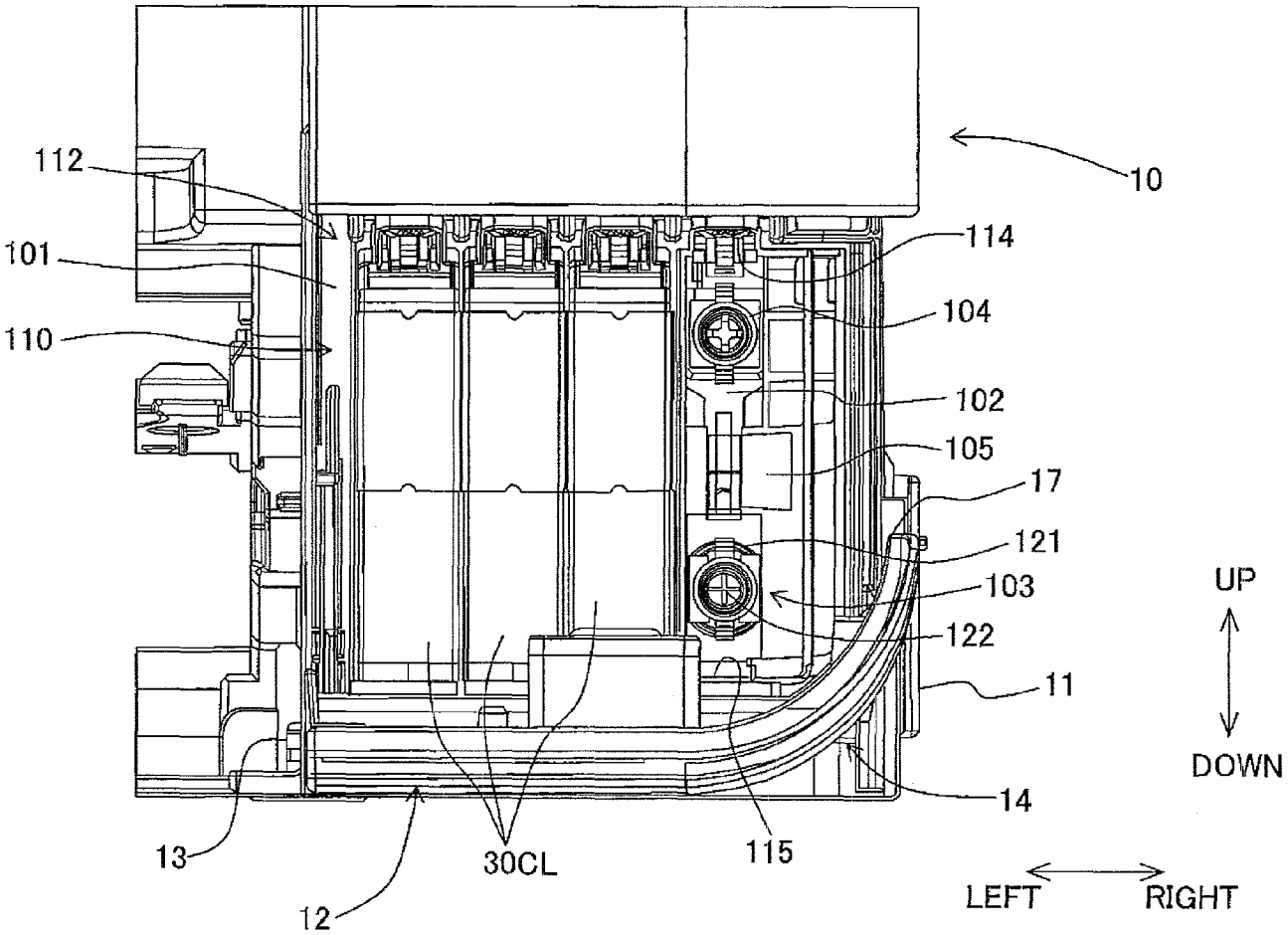
FIG. 9 shows a front view illustrating the arrangement of the cartridge installing section in a state in which the ink black ink cartridge is not installed.
Figure 10:
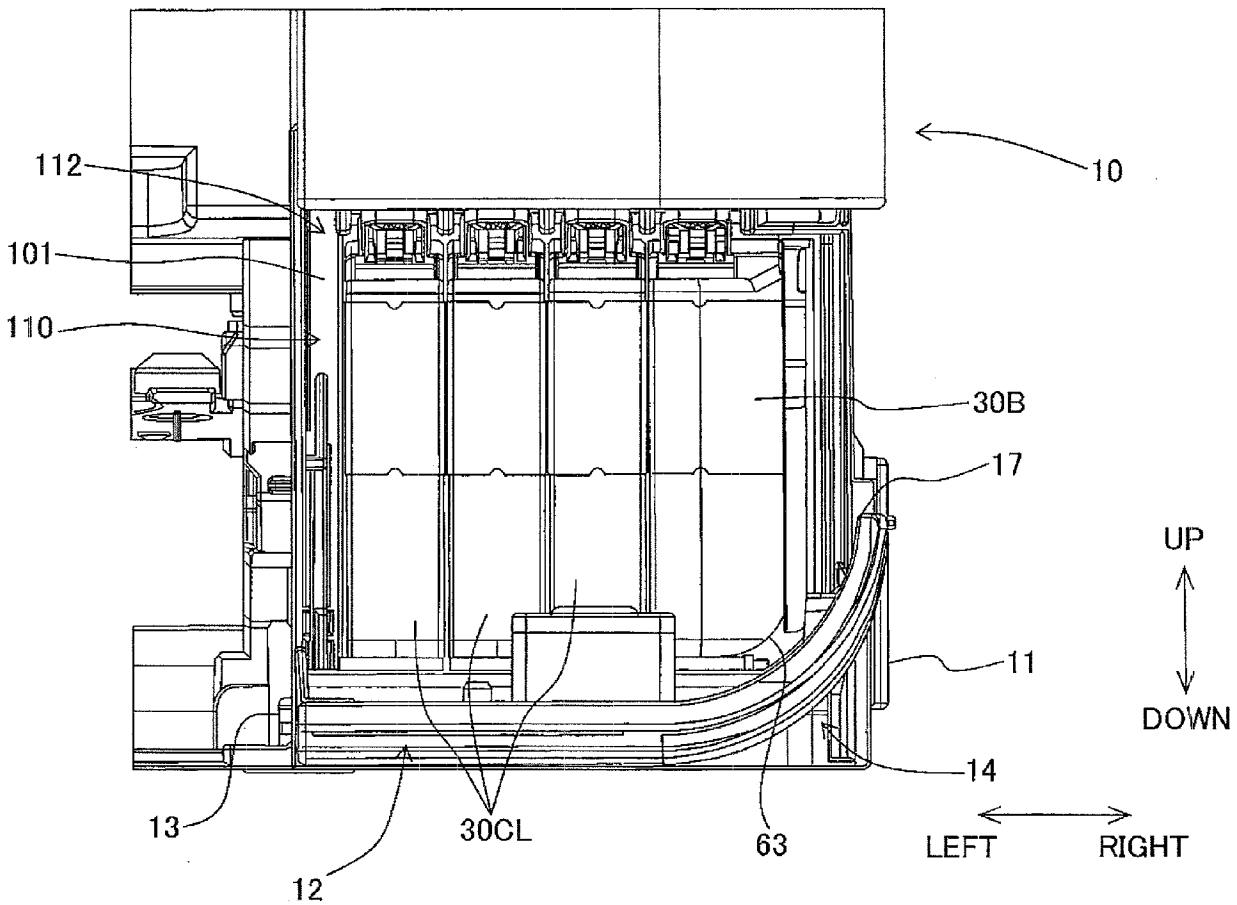
FIG. 10 shows a front view illustrating the arrangement of the cartridge installing section in a state in which the black ink cartridge is installed.

As shown in FIGS. 8 to 10, the cartridge installing section 110 is arranged at the right end on the front surface of the printer 10. The case 101, which serves as a casing for the cartridge installing section 110, has a box-shaped form (i.e., rectangular parallelepiped form) having an opening 112 disposed on the front surface side of the printer 10. The case 101 is arranged in the internal space of the casing 11 of the printer 10. The casing 11 is also open on the side of the opening 112 of the case 101. The opening of the casing 11 is openable/closable by the lid 12. The ink cartridges 30B, 30CL are inserted into or removed from the case 101 via the opening 112 in a state in which the lid 12 is in the open posture (see FIG. 8). The case 101 is capable of accommodating, for example, the ink cartridges 30B and 30CL corresponding to the respective colors of black, cyan, magenta, and yellow.

As shown in FIGS. 8 to 10, the lid 12 has a rotary shaft 13 disposed in the vicinity of the bottom of the casing 11. The rotary shaft 13 is rotatably supported by the casing 11, and thus the lid 12 is connected rotatably with respect to the casing 11. As shown in FIG. 8, the posture, in which the opening of the casing 11 is opened by the lid 12, is referred to as "open posture". As shown in FIG. 1I, the posture, in which the opening of the casing 11 is closed by the lid 12, is referred to as "closed posture". The lid 12 is rotated about the rotary shaft 13, and thus the lid 12 undergoes the posture change to the open posture and the closed posture.

The lid 12 is a slender thin plate, which has the curved section 14 being curved toward an end portion 17 on one side in the direction in which rotary shaft 13 extends, corresponding to the corner portion of the casing 11 formed to have the curved surface. The curved section 14 forms a part of the curved surface of the corner portion of the casing 11 in the state in which the lid 12 is in the closed posture (see FIG. 10). The curved section 14 constitutes the front surface and the side surface of the casing 11 in the closed posture. The end portion 17 of the lid 12 is directed toward the side of an ending surface 102 opposed to the opening 112 of the case 101 (toward the side of the back surface of the casing 11) in the state in which the lid 12 is in the closed posture. The curved section 14 is upstanding upwardly from the side of the bottom surface of the case 101 in the open posture. In the open posture, the end portion 17 of the lid 12 is positioned over or above the ink supply tube 122 as described later on.

A fastening pawl 18 is provided on the forward end side which is disposed on the side opposite to the rotary shaft 13, on the end portion 17 of the lid 12. The fastening pawl 18 extends from the end portion 17 to the inner side of the lid 12 along with the direction in which the rotary shaft 13 extends. The fastening pawl 18 is bent and folded in a clasp-shaped form on the forward end side thereof. The fastening pawl 18 enters an engaging section 19 formed at the edge of the opening of the casing 11 to effect the engagement, from the outer side of the curvature of the curved section 14. The fastening pawl 18 is engaged with the engaging section 19, and thus the lid 12 is retained in the closed posture.

As shown in FIG. 9, the case 101 has the ending surface 102 which is disposed at the opposing position with respect to the opening 112 in the insertion and removal direction 50 and which confronts the internal space of the case 101. A connecting section 103 is provided, for example, at a lower portion of the ending surface 102 of the case 101. The connecting section 103 is arranged on the ending surface 102 at a position corresponding to the ink supply section 43 of the ink cartridge 30B installed to the case 101. In FIG. 9, the ending surface 102, which is disposed at the right end of the case 101 corresponding to the ink cartridge 30B, appears. FIG. 9 also shows a state in which the ink cartridges 30CL are installed at the other positions.

The connecting section 103 has an ink supply tube 122 and a holding section 121. Although not shown in the drawing, the ink supply tube 122 is connected to the ink tube 20 on the back surface side of the case 101. The respective ink tubes 20, which are connected to the respective ink supply tubes 122, are connected so that the inks can flow to the recording head 21 of the printer 10.

The holding section 121 is formed, for example, on the ending surface 102 of the case 101. The holding section 121 is formed by depressing a part of the ending surface 102 in a cylindrical form. The ink supply tube 122 is arranged to protrude in the removal orientation 55 at the center of the holding section 121. When the ink cartridge 30B is installed to the cartridge installing section 110, the cylindrical ink supply section 43 is inserted into the cylindrical holding section 121. In this situation, the outer circumferential surface of the ink supply section 43 is brought in contact with, for example, brought in tight contact with the surface which defines the holding section 121. When the ink supply section 43 is inserted into the holding section 121, then the ink supply tube 122 is inserted into the ink supply port 71 of the ink supply section 43, and the ink supply tube 122 moves the valve. Accordingly, the valve, which has been disposed at the closed position, is moved to the open position against the urging action of the coil spring, and the ink, which is stored in the ink chamber 36, can flow to the outside. The ink, which is allowed to outflow from the ink chamber 36, flows into the ink supply tube 122 in accordance with, for example, the water head difference. The ink flows to the recording head 21 via the ink tube 20. The ink supply tube 122 corresponds to the printing fluid supply tube.

A rod 104 is provided, for example, at an upper portion of the ending surface 102 of the case 101. The rod 104 is arranged at a position on the ending surface 102 corresponding to the atmospheric air communication port 72 of the ink cartridge 30B installed to the case 101. When the ink cartridge 30B is installed to the cartridge installing section 110, the rod 104 abuts against the atmospheric air communication port 72 to move the valve. Accordingly, the valve, which has been at the closed position, is moved to the open position against the urging action of the coil spring, and the air layer in the ink chamber 36 is open to the atmospheric air.

An optical sensor 105 is provided, for example, at a central portion of the ending surface 102 of the case 101. The optical sensor 105 is arranged at a position on the ending surface 102 corresponding to the detecting section 73 of the ink cartridge 30B installed to the case 101. When the ink cartridge 30B is installed to the cartridge installing section 110, the detecting section 73 is positioned between a light-emitting section and a light-receiving section of the optical sensor 105. The infrared light, which is radiated from the light-emitting section of the optical sensor 105, passes through the detecting section 73, and the light is received by the light-receiving section. For example, the detecting section 73 shuts off, attenuates, and/or reflects the infrared light, and thus the intensity of the light received by the light-receiving section differs. Therefore, the ink remaining amount in the ink chamber 36 is judged on the basis of the intensity.

Guide rails 114, 115 are formed on a top surface and a bottom surface for defining the internal space of the case 101 respectively. The guide rails 114, 115 are grooves each of which is recessed in the upward-downward direction from the top surface or the bottom surface. The widths of the grooves are slightly wider than the widths of the guide sections 47, 48 of the ink cartridge 30. The guide rails 114, 115 extend in a straight form from the opening 112 to the ending surface 102 respectively. When the ink cartridge 30 is inserted into or extracted from the internal space of the case 101, the guide sections 47, 48 are inserted into the guide rails 114, 115. The ink cartridge 30 is guided linearly in a straight form between the opening 112 and the ending surface 102 of the case 101.

As shown in FIG. 1, the engaging member 106 is provided for the case 101. The engaging member 106 is provided in order that the ink cartridge 30, which is installed to the cartridge installing section 110, is retained in the installed state. The engaging member 106 is provided, for example, on the top surface on the side of the opening 112 of the case 101.

The engaging member 106 is formed, for example, swingably about the center of a support shaft 107. The support shaft 107 is provided, for example, at the end portion of the top surface disposed on the side of the opening 112 of the engaging member 106. The support shaft 107 is attached, for example, to the case 101. Accordingly, the engaging member 106 is supported rotatably about the center of the support shaft 107 on the top surface in the vicinity of the opening 112 of the case 101. The engaging member 106 is engageable with the fastening section 45 of the ink cartridge 30. When the engaging member 106 is engaged with the fastening section 45, the ink cartridge 30 is retained at the installed position with respect to the case 101 against the urging force of a slide member 108. The position of rotation, at which the engaging member 106 is disposed at the position capable of being engaged with the fastening section 45, is referred to as "lock position". The position of rotation, at which the engaging member 106 is not engaged with the fastening section 45, is referred to as "unlock position".

The engaging member 106 is rotatable downwardly in the direction of the gravity about the center of the support shaft 107, for example, by means of the self-weight or a coil spring. When the forward end portion 81 of the rotatable member 80 is moved upwardly, then the engaging member 106 is rotated upwardly about the center of the support shaft 107, and the engaging member 106 is moved from the lock position to the unlock position. Although not shown in the respective drawings, for example, the rotational movement may be regulated so that the engaging member 106 is not moved upwardly from the unlock position, in relation to the movable range of the engaging member 106.

As shown in FIG. 1, for example, an accommodating section, which is expanded in the insertion orientation 56, is formed on the lower end side of the ending surface 102 of the cartridge installing section 110. The expanded accommodating section exists on the extension line of the guide rail 115. The slide member 108 is provided in the expanded accommodating section so that the slide member 108 is slidable (horizontally movable) in the insertion and removal direction 50. The slide member 108 has, for example, a substantially rectangular parallelepiped-shaped outer shape. The slide member 108 is positioned on the extension line of the guide rail 115. The slide member 108 is overlapped with the advance route of the projection 32 of the ink cartridge 30. The slide member 108 is capable of abutting against the projection 32 during the process in which the ink cartridge 30 is installed to the cartridge installing section 110.

The coil spring 109 is provided in a compressed state between the slide member 108 and the ending surface of the accommodating section in which the slide member 108 is accommodated. The slide member 108 is urged in the removal orientation 55 by the coil spring 109. Therefore, the slide member 108 is brought in contact with, for example, the front surface of the accommodating section at the position at which any external force is not applied, and thus the movement thereof is regulated. When the ink cartridge 30 is further inserted from the state in which the projection 32 of the ink cartridge 30 is brought in contact with the slide member 108, the coil spring 109 is compressed in accordance with the movement of the slide member 108.

<Installation Operation of Ink Cartridge 30>

An explanation will be made below about the operation in which the ink cartridges 30B, 30CL are installed to the cartridge installing section 110 respectively.

The ink cartridge 30B has the width wider than that of the ink cartridge 30CL. The ink cartridge 30B is installed to the most rightward position (first position) in the cartridge installing section 110 as shown in FIG. 10. When the ink cartridge 30B is installed, the lid 12 of the casing 11 of the printer 10 is firstly subjected to the posture change from the closed posture to the open posture. Accordingly, the opening 112 of the case 101 of the cartridge installing section 110 is exposed on the front surface side of the printer 10.

The ink cartridge 30B is inserted from the side of the front wall 40 of the ink cartridge 30B via the opening 112. As described above, the second surface 62 of the ink cartridge 30B is the curved surface and the corner portion 63 of the ink cartridge 30B is chamfered. Therefore, the ink cartridge 30B is easily distinguished from the ink cartridge 30CL on the basis of the outer shape.

As shown in FIG. 10, the curved section 14 of the lid 12 in the open posture is upstanding upwardly from the bottom surface side of the case 101 at the outside of the opening 112. When the ink cartridge 30B is inserted into the opening 112 of the case 101, the ink cartridge 30B is positioned over or above the curved section 14 of the lid 12 in the open posture. The corner portion 63 of the ink cartridge 30B is chamfered so that the corner portion 63 does not abut against the inner surface of the curved section 14. Therefore, when the ink cartridge 30B is installed to the right end side of the case 101, the curved section 14 does not abut against the ink cartridge 30B. When the ink cartridge 30B is inserted into the case 101, the curved section 14 of the lid 12 is opposed to the corner portion 63 having the curved surface 64. In this situation, the curved section 14 and the curved surface 64 are similarly curved from the right direction to the upward direction of the casing 11. Therefore, the user can visually recognize the ink cartridge 30B with ease in accordance with the comparison of the curved section 14 with the curved surface 64. The curvature of the curved surface 64 of the ink cartridge 30B is closer to the curvature of the curved section 14 of the lid 12 than the curvature of the corner portion 163 of the ink cartridge 30CL.

The ink cartridge 30B is allowed to pass through the opening 112, and the ink cartridge 30B is inserted from the side of the front wall 40 of the ink cartridge 30B. When the ink cartridge 30B is inserted into the opening 112, the guide sections 47, 48 of the ink cartridge 30B enter the guide rails 114, 115 of the case 101 respectively. The guide sections 47, 48 are inserted into the guide rails 114, 115, and the ink cartridge 30B is guided straight from the opening 112 to the ending surface 102.

When the front wall 40 of the ink cartridge 30B is inserted into the case 101 to arrive at a position in the vicinity of the engaging member 106, the casing 31 is brought in contact with the engaging member 106. When the ink cartridge 30 is further inserted into the cartridge installing section 110, the engaging member 106 rides on the upper surface of the guide section 47. The engaging member 106 is rotated counterclockwise as viewed in FIG. 1, and the engaging member 106 is moved from the lock position to the unlock position.

The ink supply section 43 is brought in contact with the holding section 121 during the execution process in which the ink cartridge 30B is installed to the cartridge installing section 110. The ink supply tube 122 is inserted into the ink supply port 71 of the ink supply section 43. The atmospheric air communication port 72 abuts against the rod 104, and the atmospheric air communication port 72 is opened. The detecting section 73 arrives at the detection position for the optical sensor 105.

The projection 32 abuts against the slide member 108 during the execution process in which the ink cartridge 30B is installed to the cartridge installing section 110. When the ink cartridge 30B is further moved in the insertion orientation 56, the slide member 108 is moved toward the ending surface against the urging action of the coil spring 109.

As shown in FIG. 1, when the ink cartridge 30B arrives at the installation position, the fastening surface 46 of the fastening section 45 of the casing 31 passes over the engaging member 106 in the insertion orientation 56. Accordingly, the engaging member 106 is not supported by the upper surface of the guide section 47. Therefore, the engaging member 106 is rotated clockwise as viewed in FIG. 1, and the engaging member 106 is positioned at the engaging section 45. The engaging member 106 is brought in contact with the fastening surface 46. When the engaging member 106 is engaged with the fastening section 45, the ink cartridge 30B is retained at the installation position against the urging action of the coil spring 109. In this way, the installation of the ink cartridge 30B to the cartridge installing section 110 is completed.

Figure 11:
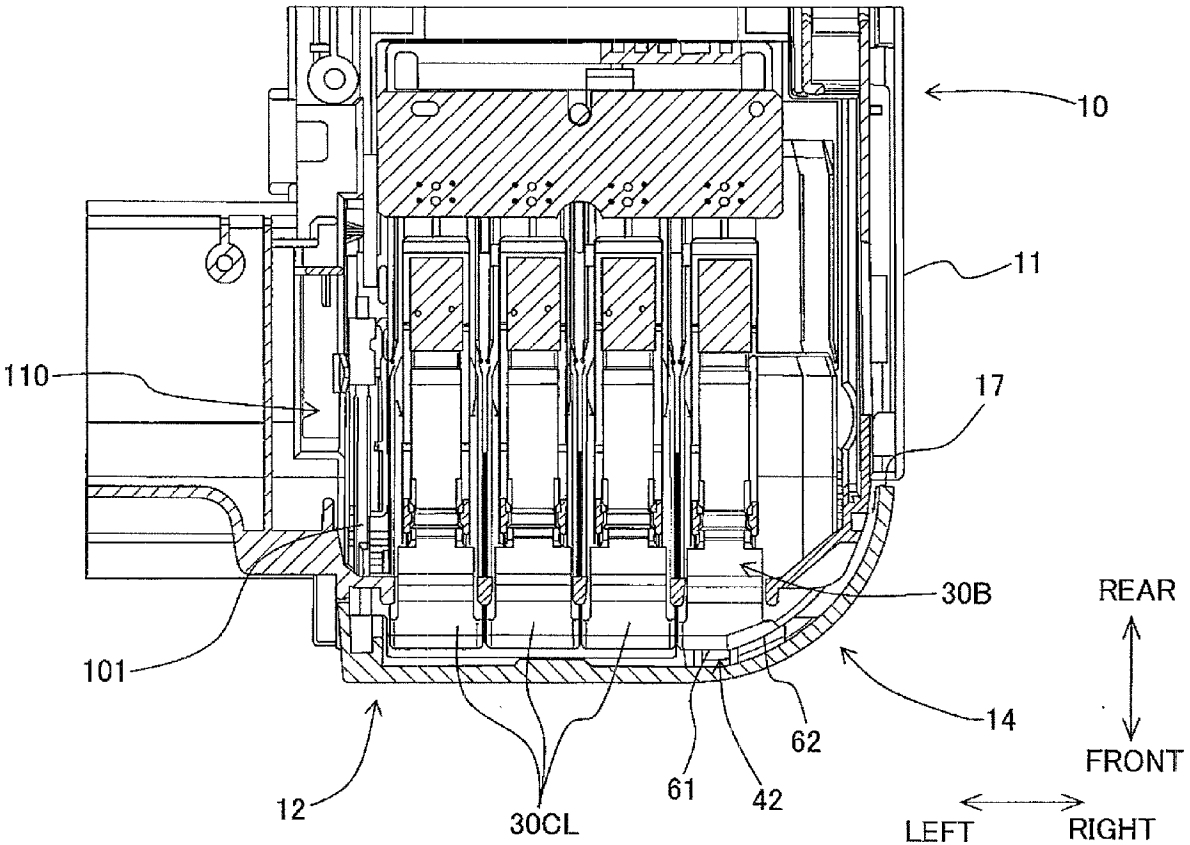
FIG. 11 shows a sectional view illustrating a state in which the black ink cartridge is installed to a proper position of the cartridge installing section.

When the installation of the ink cartridge 30B is completed, the lid 12 of the casing 11 of the printer 10 is subjected to the posture change from the open posture to the closed posture. As described above, the second surface 62 of the back wall 42 of the ink cartridge 30B is the curved surface which is curved along the inner surface shape of the curved section 14 of the lid 12. Therefore, as shown in FIG. 11, even when the lid 12 is in the closed posture, the back wall 42 does not abut against the inner surface of the lid 12. The lid 12 is allowed to be in the closed posture, and the fastening pawl 18 of the lid 12 is engaged with the engaging section 19 of the casing 11. Accordingly, the lid 12 is retained in the closed posture.

When the ink contained in the ink chamber 36 of the ink cartridge 30 is consumed, then the used ink cartridge 30 is removed from the cartridge installing section 110, and a new ink cartridge 30 is installed.

When the ink cartridge 30 is removed from the cartridge installing section 110, the lid 12 of the casing 11 is subjected to the posture change from the closed posture to the open posture in the same manner as described above. Further, the backward end portion 82 of the rotatable member 80 is depressed downwardly by the user. The backward end portion 82 of the rotatable member 80 is positioned on the front side as compared with the back wall 42. Therefore, the user can operate the rotatable member 80 from the side of the back wall 42 of the ink cartridge 30. Accordingly, the forward end portion 81 of the rotatable member 80 is moved upwardly, and the forward end portion 81 of the rotatable member 80 is separated from the bottom surface of the fastening section 45. The engaging member 106 is pushed and lifted upwardly by the forward end portion 81 of the rotatable member 80 in accordance with the movement of the forward end portion 81. Therefore, the engaging member 106 is rotated until the engaging member 106 is disposed on the upper side as compared with the fastening surface 46, i.e., until the engaging member 106 is separated from the fastening surface 46. That is, the engaging member 106 is rotated from the lock position to the unlock position. The ink cartridge 30 is released from the retention having been effected by the engaging member 106.

When the engaging member 106 is separated from the fastening surface 46, the force, which moves the casing 31 in the removal orientation 55, is allowed to act in accordance with the external force applied to the casing 31, i.e., the urging force brought about by the coil spring 109. On the other hand, the user depresses the rotatable member 80 downwardly. Therefore, the urging force, which is exerted by the coil spring 109, is received by the hand of the user via the rotatable member 80. When the user withdraws the hand in the removal orientation 55, the ink cartridge 30 is moved to the outside from the opening 112 of the cartridge installing section 110 by the urging force of the coil spring 109.

When the ink cartridge 30B is removed from the cartridge installing section 110, it is feared that the ink may be scattered from the ink supply port 71. When the ink cartridge 30B is being removed from the cartridge installing section 110, volume of a space defined by an inner surface of the ink supply section 43 and an outer surface of the ink supply tube 122 is expanded in a state that the seal of the ink supply port 71 is maintained. Accordingly, this space becomes negative pressure. When the ink cartridge 30B is further moved in the removal orientation 55 and the seal of the ink supply port 71 is released, the ink leaks from the ink supply port 71 and/or the ink supply tube 122 to adhere to the vicinity of the ink supply port 71. The ink adhered to the vicinity of the ink supply port 71 is sometimes scattered when the ink cartridge 30B is removed from the cartridge installing section 110. However, as described above, the end portion 17 of the lid 12 in the open posture is disposed over or above the ink supply tube 122. Therefore, the ink droplets, which are scattered from the ink supply port 71 and which jump out to the outside of the casing 11 from the opening 112 of the case 101, adhere to the inner surface of the curved section 14. Therefore, the ink droplets are suppressed from being scattered to the outside from the lid 12. Similarly, when the ink cartridge 30CL is removed from the cartridge installing section 110, it is feared that the ink may be scattered from the ink supply port 171. However, since the end portion 17 of the lid 12 in the open posture is disposed over or above the ink supply tube 122, the ink droplets are suppressed from being scattered to the outside from the lid 12.

As described above, the corner portion 63 of the ink cartridge 30B is chamfered so that the corner portion 63 does not abut against the inner surface of the curved section 14. Therefore, when the ink cartridge 30B is removed through the opening 112 of the case 101, the curved section 14 does not abut against the ink cartridge 30B. For example, even when the user releases the hand from the ink cartridge 30B over or above the lid 12 in the open posture, the ink cartridge 30B is supported by the inner surface of the curved section 14. Therefore, the ink cartridge 30B is prevented from falling down while exceeding the curved section 14

Next, an explanation will be made about the operation to be performed when the ink cartridge 30CL, which is to be installed to a position (second position) other than the right end of the case 101 of the cartridge installing section 110, is erroneously installed to the position to which the ink cartridge 30B is to be installed, i.e., to the right end (first position) of the case 101 of the cartridge installing section 110.

The width of the ink cartridge 30CL is narrower than that of the ink cartridge 30B. Therefore, the ink cartridge 30CL can be inserted into the right end side of the cartridge installing section 110 to which the ink cartridge 30B having the wide width can be installed. Therefore, the user may erroneously insert the ink cartridge 30CL to the right end of the cartridge installing section 110.

After the lid 12 of the casing 11 of the printer 10 is subjected to the posture change from the closed posture to the open posture in the same manner as described above, the ink cartridge 30CL is inserted into the case 101 from the side of the front wall 140 via the opening 112. When the ink cartridge 30CL is inserted into the case 101, then the ink supply section 143 is brought in contact with the holding section 121, the ink supply tube 122 is inserted into the ink supply port 171 of the ink supply section 143, and the atmospheric air communication port 172 abuts against the rod 104 so that the atmospheric air communication port 172 is opened. Further, the detecting section 173 arrives at the detection position for the optical sensor 105.

The projection 132 abuts against the slide member 108 during the execution process in which the ink cartridge 30CL is installed to the cartridge installing section 110. When the ink cartridge 30CL is further moved in the insertion orientation 56, the slide member 108 is moved to the ending surface side against the urging action of the coil spring 109. When the engaging member 106 is engaged with the fastening section 145, the ink cartridge 30CL is retained at the installation position against the urging action of the coil spring 109.

Figure 12:
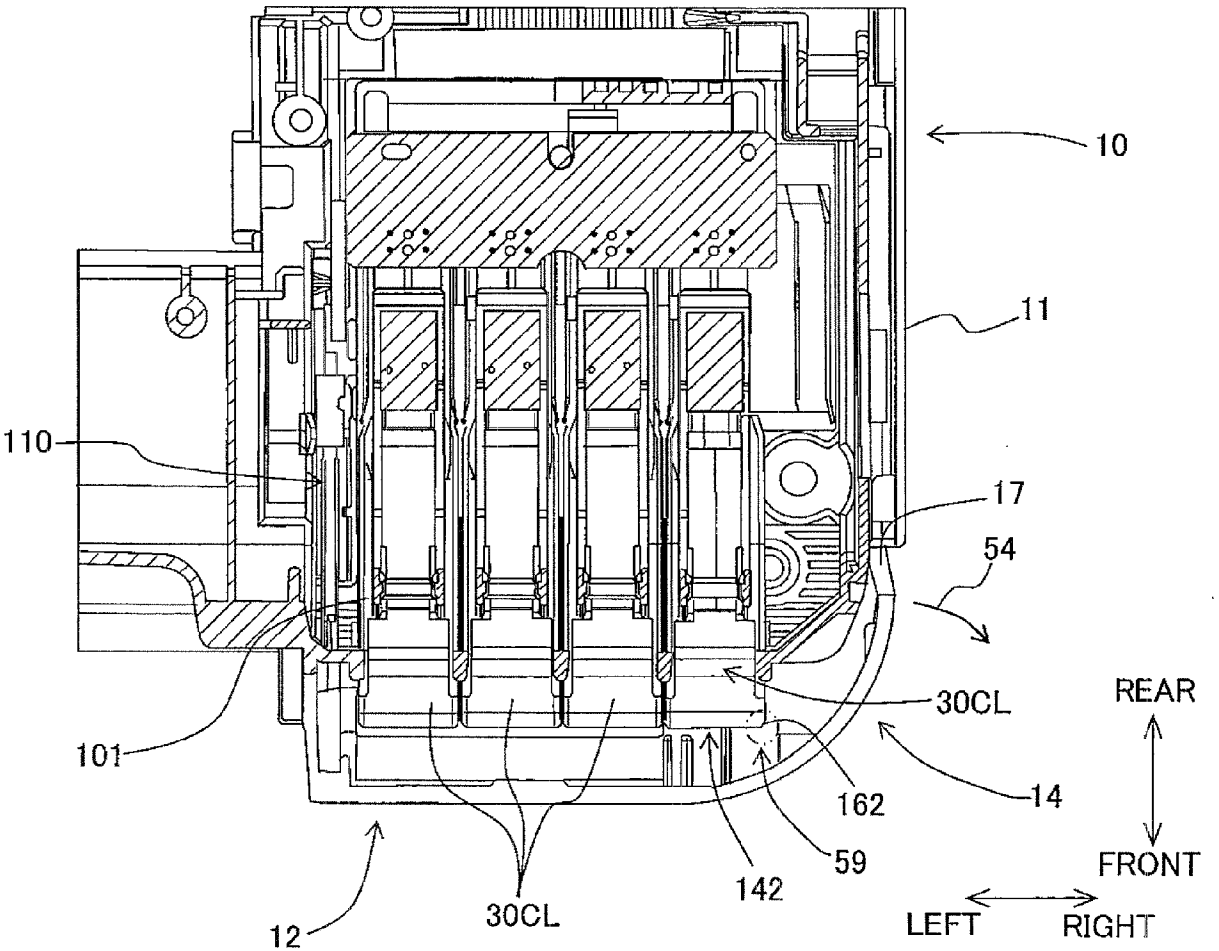
FIG. 12 shows a sectional view illustrating a state in which the color ink cartridge is installed to a position to which the black ink cartridge is to be installed.

Subsequently, the corner portion 162 of the back wall 142 abuts against the inner surface of the curved section 14 of the lid 12 as shown in FIG. 12 during the process in which the lid 12 of the casing 11 of the printer 10 is subjected to the posture change from the open posture to the closed posture. FIG. 12 shows a state in which the lid 12 and the corner portion 162 are viewed from an upward position. The inner surface of the curved section 14 of the lid 12 abuts against the lower side of the corner portion 162. The abutment position is shown by an arrow affixed with reference numeral 59 in FIG. 12. Owing to the abutment, the fastening pawl 18 (see FIG. 8), which is disposed on the upper side of the lid 12, cannot arrive at the engaging section 19 (see FIG. 8). The lid 12 is restrained from the posture change from the open posture to the closed posture. In other words, the lid 12 cannot be in the closed posture. Therefore, the user recognizes that the ink cartridge 30CL is installed to the erroneous position. As described above, if the user intends to forcibly push the rotation forward end side of the lid 12 to provide the closed posture in a state in which the inner surface of the curved section 14 of the lid 12 abuts against the corner portion 162, the curved section 14 of the lid 12 is deformed in a direction indicated by an arrow 54 on account of the abutment between the curved section 14 and the corner portion 162. The fastening section 18 is engageable with the engaging section 19 from the outer side. Therefore, as a result of the deformation of the curved section 14, the fastening section 18 is not maintained in a state in which the fastening section 18 is engaged with the engaging section 19. Therefore, when the user stops pushing the lid 12, then the deformation of the curved section 14 is elastically restored, and the lid 12 is not in the closed posture. If the width of the ink cartridge 30CL is too narrow, the corner portion 162 does not abut against the curved section 14 of the lid 12. Therefore, it is necessary that the ink cartridge 30CL should have a sufficient width so that the corner portion 162 abuts against the curved section 14 when the lid 12 is allowed to be in the closed posture.

<Function and Effect of this Embodiment>

According to this embodiment, the ink cartridge 30B has the corner portion 63 which is chamfered. Therefore, it is possible to easily judge the type according to the outer shape.

When the ink cartridge 30B is inserted into the right end side of the case 101, the curved section 14 of the lid 12 in the open posture is opposed to the corner portion 63. Therefore, the user can visually recognize the ink cartridge 30B with ease.

In the open posture, the curved section 14 of the lid 12 is upstanding upwardly from the bottom surface side of the case 101. Therefore, the ink, which is scattered from the ink supply port 71 or the ink supply tube 122, is suppressed from being scattered or spattered to the outside of the lid 12, by means of the curved section 14.

According to this embodiment, the corner portion of the back wall 42 of the ink cartridge 30B is chamfered. Therefore, the type of the ink cartridge 30B can be easily distinguished on the basis of the outer shape. As for the ink cartridge 30CL, the corner portion 162 of the back wall 142 abuts against the curved section 14 of the lid 12 which undergoes the posture change to the closed posture. Therefore, if the ink cartridge 30CL is installed to the right end side to which the ink cartridge 30B is to be installed, it is impossible to allow the lid 12 to be in the closed posture. According to the fact that the lid 12 is not closed, the user recognizes the erroneous installation of the ink cartridge 30CL.

The lid 12 is retained in the closed posture such that the fastening pawl 18, which is provided at the end portion of the curved section 14, is engaged with the engaging section 19 of the casing 11 from the outer side of the curvature. As described above, if the user forcibly pushes the lid 12 from the state in which the lid 12 abuts against the corner portion 162 of the ink cartridge 30CL, the lid 12 is deformed in the direction (arrow 54) in which the radius of curvature of the curved section 14 is increased. Accordingly, the fastening pawl 18 cannot be engaged with the engaging section 19. Therefore, when the user stops the action to forcibly push the lid 12, then the lid 12 is not retained in the closed posture, and the lid 12 elastically returns to the original shape from the deformed state. According to the fact that the lid 12 cannot be maintained in the closed posture, the user can recognize the erroneous installation of the ink cartridge 30CL.

The ink cartridge 30B stores the pigment-based ink (for example, black ink), and the ink cartridge 30CL stores the dye-based ink (for example, ink of any one of colors of cyan, magenta, and yellow). Therefore, if the ink cartridge 30CL is installed to the position to which the ink cartridge 30B is to be installed, the inks of the different types are mixed and solidified, for example, in the ink tube 20 in some cases. However, in this embodiment, the corner portion 162 of the back wall 142 of the ink cartridge 30CL abuts against the inner surface of the curved section 14 of the lid 12 during the process in which the lid 12 of the casing 11 of the printer 10 is subjected to the posture change from the open posture to the closed posture. Therefore, the lid 12 is restrained from the posture change from the open posture to the closed posture. As a result, the dye-based ink and the pigment-based ink are prevented from being mixed and solidified in the ink tube 20.

Modified Embodiment

In the embodiment described above, the width of the ink cartridge 30B in the widthwise direction 51 is wider than the width of the ink cartridge 30CL in the widthwise direction 51. However, the width of the ink cartridge 30B may be the same as the width of the ink cartridge 30CL. In this case, the corner portion 63 of the ink cartridge 30B is chamfered so that the corner portion 63 of the ink cartridge 30B does not abut against the inner surface of the curved section when the lid 12 is allowed to be in the open posture. Therefore, when the ink cartridge 30B is installed to the right end side of the case 101, the curved section 14 does not abut against the ink cartridge 30B. However, the corner portion 163 of the ink cartridge 30CL is not chamfered so that the corner portion 163 of the ink cartridge 30CL does not abut against the inner surface of the curved section 14. Therefore, when the ink cartridge 30CL is installed to the right end side of the case 101, the curved section 14 abuts against the ink cartridge 30CL. Accordingly, the user recognizes that the ink cartridge 30CL is about to be installed to the erroneous position in the case 101.

Figure 13:
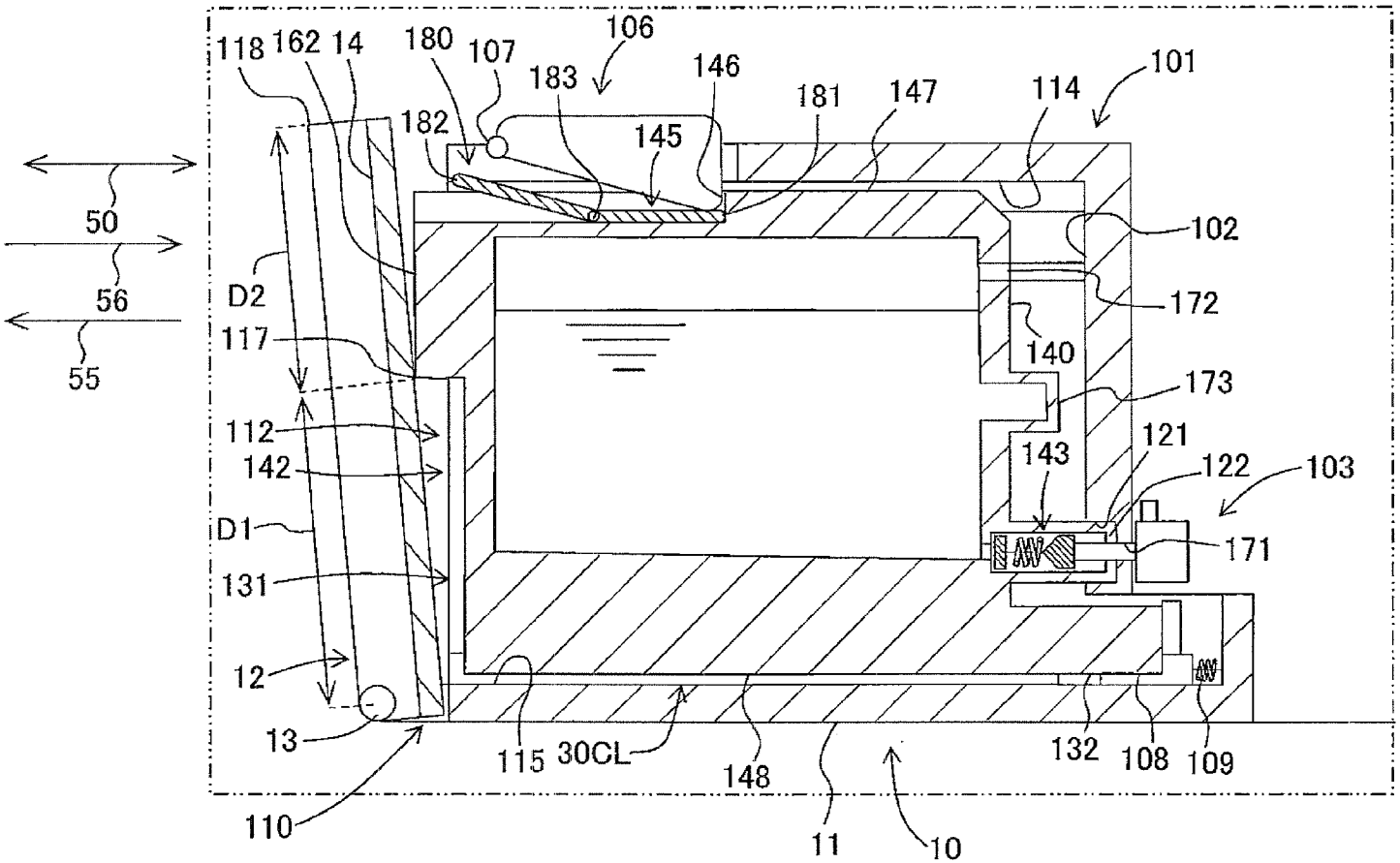
FIG. 13 shows a sectional view illustrating a state in which a color ink cartridge as a modified embodiment of the present teaching is installed to the cartridge installing section.

In another modified embodiment, as shown in FIG. 13, the lower portion of the back wall 142 of the ink cartridge 30CL has a shape which is recessed toward the front wall 140. Accordingly, in relation to the lid 12, the first distance D1, which ranges to the rotational shaft 13 from the abutment position 117 at which the corner portion 162 of the ink cartridge 30CL abuts, is longer than the second distance D2 which ranges to the forward end 118 of the rotation from the abutment position 117 (first distance D1>second distance D2). Accordingly, if the user intends to forcibly push the side of the forward end 118 of the rotation of the lid 12 to provide the closed posture, then it is possible to decrease the force applied to the rotational shaft 13, and it is possible to prevent the rotational shaft 13 from being disengaged from the casing 11.

In the embodiment described above, the second surface 62 of the casing 31 of the ink cartridge 30B is the curved surface. The second surface 62 may be constructed as a flat surface, or a surface which is recessed toward the front wall 40 to form a step in the front-back direction 53 with respect to the first surface 61.

In the embodiment described above, the ink supply section 43 is arranged while being offset from the center in the widthwise direction 51 in relation to the front wall 40 of the casing 31. In the ink cartridge 30B, the ink supply section 42 may be arranged at the center in the widthwise direction 51 of the front wall 40 without being offset as described above.

In the embodiment described above, the corner portions 162 and 163 of the ink cartridge 30CL are not chamfered. However, the corner portion 163 of the ink cartridge 30CL may be chamfered if the corner portion 162 of the ink cartridge 30CL is formed without being chamfered. In this case, if the ink cartridge 30CL is erroneously installed to the right end of the case 101 of the cartridge installing section 110, the corner portion 162 abuts against the inner surface of the curved section 14 of the lid 12. In other words, the lid 12 cannot be in the closed posture. Therefore, the user recognizes that the ink cartridge 30CL is installed to the erroneous position.

In the embodiment described above, the mode, in which the ink as the printing fluid is accommodated in the ink cartridge 30, is shown corresponding to the printer 10 based on the ink-jet system. The printing fluid is not limited to the ink. For example, the present teaching is also applicable, for example, to a cartridge which accommodate a toner as the printing fluid corresponding to an image forming apparatus based on the electrophotographic system.

What is claimed is:

1. A recording apparatus which is configured to receive a plurality of printing fluid cartridges, the recording apparatus comprising:

a printing section configured to perform printing by using printing fluids contained in the printing fluid cartridges;

a cartridge installing section configured to include:

a case which is formed with an opening and which is configured to receive the printing fluid cartridges respectively via the opening;

a flat plate-shaped lid which has a rotational shaft and which undergoes posture change to a closed posture to close the opening and an open posture to open the opening by being rotated around the rotational shaft; and printing fluid supply tubes each of which is provided on an ending surface of the case opposed to the opening and each of which is configured to be connectable to one of the printing fluid cartridges so that the printing fluid contained in the printing fluid cartridges is derived to the printing section;

wherein the lid has a curved section which is disposed on a side of one end in a widthwise direction along the rotational shaft and which is curved so that the one end is directed to a side of the ending surface of the case in a state in which the lid is in the closed posture;

wherein the curved section is upstanding upwardly from a side of a bottom surface of the case in a state in which the lid is in the open posture; and a printing fluid cartridge set which is configured to be installable to the cartridge installing section;

wherein the printing fluid cartridge set includes:

a first printing fluid cartridge which is configured to be installable to a first position disposed nearest to the one end side of the case; and a second printing fluid cartridge which is configured to be installable to a second position different from the first position of the case;

wherein the first printing fluid cartridge has a box-shaped form which has:

an upper wall;

a bottom wall;

a front wall which passes through the opening at first under a condition that the first printing fluid cartridge is inserted into the case;

a back wall which passes through the opening at last under the condition that the first printing fluid cartridge is inserted into the case; and side walls to connect the front wall and the back wall;

wherein the first printing fluid cartridge has a first corner portion, which is formed by the back wall and the side wall disposed on the one end side, and which is chamfered so that the first corner portion does not abut against the curved section in the state in which the lid is in the closed state; and wherein the second printing fluid cartridge has a box-shaped form which has:

an upper wall;

a bottom wall;

a front wall which passes through the opening at first under a condition that the second printing fluid cartridge is inserted into the case;

a back wall which passes through the opening at last under the condition that the second printing fluid cartridge is inserted into the case; and side walls to connect the front wall and the back wall;

wherein the second printing fluid cartridge has a second corner portion, which is formed by the back wall and the side wall disposed on the one end side, and which is not chamfered.

2. The recording apparatus according to claim 1;

wherein the one end of the lid is positioned over or above the printing fluid supply tubes in the state in which the lid is in the open posture.

3. The recording apparatus according to claim 1;

wherein each of the first and second printing fluid cartridges has:

a printing fluid supply port which is configured to be connectable to one of the printing fluid supply tubes; and an atmospheric air communication port which is configured to be communicatable with atmospheric air over or above the printing fluid supply port; and wherein air, which stays in each of the printing fluid cartridges, is released outside of each of the printing fluid cartridges via the atmospheric air communication port.

4. The recording apparatus according to claim 1;

wherein the first printing fluid cartridge has a third corner portion, which is formed by the bottom wall and the side wall on the one end side of the first printing fluid cartridge, and which is chamfered so that the third corner portion does not abut against the curved section of the lid in the state in which the lid is in the open posture; and wherein the second printing fluid cartridge has a fourth corner portion, which is formed by the bottom wall and the side wall on the one end side of the second printing fluid cartridge, and which is not chamfered.

5. The recording apparatus according to claim 4;

wherein the third corner portion of the first printing fluid cartridge is a curved surface along the curved section of the lid in the open posture.

6. The recording apparatus according to claim 1;

wherein the first printing fluid cartridge is configured to store a pigment-based ink; and wherein the second printing fluid cartridge is configured to store a dye-based ink.

7. The recording apparatus according to claim 1;

wherein the first printing fluid cartridge is configured to store the printing fluid of a black color; and wherein the second printing fluid cartridge is configured to store the printing fluid of a color other than the black color.

8. The recording apparatus according to claim 1;

wherein the first printing fluid cartridge has a larger volume for the printing fluid than that of the second printing fluid cartridge.

9. The recording apparatus according to claim 1;

wherein the second corner portion of the second printing fluid cartridge is configured to abut against the curved section of the lid subjected to the posture change from the open posture to the closed posture if the second printing fluid cartridge is inserted into the first position; and wherein the second printing fluid cartridge is configured such that a first distance, which ranges from an abutment position of the lid, against which the second corner portion of the second printing fluid cartridge abuts, to the rotational shaft of the lid, is longer than a second distance which ranges from the abutment position to a forward end of the lid.

10. The recording apparatus according to claim 1;

wherein the lid has a fastening pawl which is provided at an end portion of the curved section, and the lid is configured to be retained in the closed posture by engagement of the fastening pawl with the recording apparatus from an outer side in a direction of curvature of the curved section.

11. The recording apparatus according to claim 1;

wherein the first corner portion of the first printing fluid cartridge is a curved surface along the curved section of the lid in the closed posture.

12. A printing fluid cartridge set which is configured to be installable to a recording apparatus;

the printing fluid cartridge set comprising:

a first printing fluid cartridge; and a second printing fluid cartridge; and the recording apparatus comprising:

a printing section configured to perform printing by using printing fluids contained in the first and second printing fluid cartridges; and a cartridge installing section configured to include:

a case which is formed with an opening and which is configured to receive the first and second printing fluid cartridges respectively via the opening;

a flat plate-shaped lid which has a rotational shaft and which undergoes posture change to a closed posture to close the opening and an open posture to open the opening by being rotated around the rotational shaft; and printing fluid supply tubes each of which is provided on an ending surface of the case opposed to the opening and each of which is configured to be connectable to one of the first and second printing fluid cartridges so that the printing fluid contained in the first and second printing fluid cartridges is derived to the printing section;

wherein the lid has a curved section which is disposed on a side of one end in a widthwise direction along the rotational shaft and which is curved so that the one end is directed to a side of the ending surface of the case in a state in which the lid is in the closed posture; and wherein the curved section is upstanding upwardly from a side of a bottom surface of the case in a state in which the lid is in the open posture;

wherein the first printing fluid cartridge is configured to be installable to a first position disposed nearest to the one end side of the case;

wherein the second printing fluid cartridge is configured to be installable to a second position different from the first position of the case;

wherein the first printing fluid cartridge has a box-shaped form which has:

an upper wall;

a bottom wall;

a front wall which passes through the opening at first under a condition that the first printing fluid cartridge is inserted into the case;

a back wall which passes through the opening at last under the condition that the first printing fluid cartridge is inserted into the case; and side walls to connect the front wall and the back wall;

wherein the first printing fluid cartridge has a first corner portion, which is formed by the back wall and the side wall disposed on the one end side, and which is chamfered so that the first corner portion does not abut against the curved section in the state in which the lid is in the closed state; and wherein the second printing fluid cartridge has a box-shaped form which has:

an upper wall;

a bottom wall;

a front wall which passes through the opening at first under a condition that the second printing fluid cartridge is inserted into the case;

a back wall which passes through the opening at last under the condition that the second printing fluid cartridge is inserted into the case; and side walls to connect the front wall and the back wall;

wherein the second printing fluid cartridge has a second corner portion, which is formed by the back wall and the side wall disposed on the one end side, and which is not chamfered.

* * * * *